US010526195B2

(12) United States Patent
Tillotson et al.

(10) Patent No.: US 10,526,195 B2
(45) Date of Patent: Jan. 7, 2020

(54) SYSTEMS AND METHODS FOR SUPPLYING FUEL TO A VEHICLE

(71) Applicant: The Boeing Company, Chicago, IL (US)

(72) Inventors: Brian Tillotson, Seattle, WA (US); Carol Elizabeth Anway, North Bend, WA (US)

(73) Assignee: The Boeing Company, Chicago, IL (US)

( * ) Notice: Subject to any disclaimer, the term of this patent is extended or adjusted under 35 U.S.C. 154(b) by 134 days.

(21) Appl. No.: 15/671,811

(22) Filed: Aug. 8, 2017

(65) Prior Publication Data

US 2019/0047842 A1 Feb. 14, 2019

(51) Int. Cl.

| | |
|---|---|
| ***B67D 7/32*** | (2010.01) |
| ***F02M 25/00*** | (2006.01) |
| ***B67D 7/04*** | (2010.01) |

(52) U.S. Cl.

CPC ..... *B67D 7/3236* (2013.01); *B67D 7/04* (2013.01); *F02M 25/00* (2013.01)

(58) Field of Classification Search

CPC .... B67D 7/3236; B67D 7/3245; F02M 25/00; B60K 15/00; B64C 3/34; B64D 37/04; B64D 37/14–37/32

See application file for complete search history.

(56) References Cited

U.S. PATENT DOCUMENTS 3,013,578 A * 12/1961 Askevold ..... B67D 7/3236 137/487.5
3,164,747 A * 1/1965 Yahnke ..... G01R 29/24 361/215
3,821,603 A * 6/1974 De La Cierva ..... B05B 5/025 361/215
5,159,523 A * 10/1992 Claassen ..... B67D 7/3236 340/649
7,408,758 B2 * 8/2008 Myers ..... H05F 3/02 361/215

OTHER PUBLICATIONS

Leonard et al., "Reduction of Electrostatic Charge in Jet Fuels During Refueler Loading," NRL Report 7415, Naval Research Laboratory, dated Jun. 20, 1972, 21 pages.
"Fuel Tank Ignition Source Prevention Guidelines," Advisory Circular, U.S. Department of Transportation, Federal Aviation Administration, dated Sep. 19, 2008, 39 pages.
"Aircraft Fueling," http://avstop.com/ac/apgeneral/aircraftfueling.html, 3 pages.

* cited by examiner

*Primary Examiner* — Andrew D StClair
(74) *Attorney, Agent, or Firm* — McDonnell Boehnen Hulbert & Berghoff LLP

(57) ABSTRACT

In an example, a method of supplying fuel to a fuel tank of a vehicle includes supplying, via a fuel line, fuel to a fuel tank of a vehicle at an initial rate of fuel flow. The act of supplying the fuel causes an electrostatic charge to accumulate on a surface of the fuel in the fuel tank. The method also includes determining a level of ionization of an air medium in the fuel tank, and determining an increased rate of fuel flow based on a difference between the determined level of ionization and a baseline level of ionization. The electrostatic charge accumulated on the surface of the fuel dissipates at an increased rate when the determined level of ionization of the air medium is higher than the baseline level of ionization. The method further includes supplying the fuel to the fuel tank at the increased rate of fuel flow.

20 Claims, 21 Drawing Sheets

SYSTEMS AND METHODS FOR SUPPLYING FUEL TO A VEHICLE

FIELD

The present disclosure generally relates to systems and methods for supplying fuel to a vehicle, and more particularly to refueling systems and methods for supplying fuel to a vehicle based on a level of ionization of an air medium in a fuel tank of the vehicle.

BACKGROUND

During a refueling operation, a fuel source supplies fuel to a fuel tank of a vehicle. As the fuel flows in a fuel line from the fuel source to the fuel tank, an electrostatic charge may be generated in the fuel due to, among other factors, friction between the fuel and the fuel line. When the fuel arrives in the fuel tank the electrostatic charge may accumulate on the surface of the fuel. The accumulated electrostatic charge may present a risk of electrical discharge between the fuel and the fuel tank and, thus, a risk of an explosion hazard. To mitigate the risk of electrical discharge, a rate of fuel flow in the fuel line is limited so that the accumulated charge remains relatively low.

SUMMARY

In an example, a method of supplying fuel to a fuel tank of a vehicle is described. The method includes supplying, via a fuel line, fuel to a fuel tank of a vehicle at an initial rate of fuel flow. The act of supplying the fuel causes an electrostatic charge to accumulate on a surface of the fuel in the fuel tank. The method also includes determining a level of ionization of an air medium in the fuel tank, and determining an increased rate of fuel flow based on a difference between the determined level of ionization and a baseline level of ionization. The electrostatic charge accumulated on the surface of the fuel dissipates at an increased rate when the determined level of ionization of the air medium is higher than the baseline level of ionization. The method further includes supplying, via the fuel line, the fuel to the fuel tank at the determined increased rate of fuel flow to reduce a time for supplying the fuel to the fuel tank.

In another example, a system for supplying fuel to a fuel tank of a vehicle is described. The system includes a fuel line configured to supply fuel to a fuel tank of a vehicle. A flow of the fuel in the fuel line causes an accumulation of an electrostatic charge on a surface of the fuel in the tank. The system also includes a sensor configured to determine a level of ionization of an air medium in the fuel tank and generate a sensor signal indicating the determined level of ionization. The system further includes a control device in communication with the sensor. The control device is configured to: (i) cause the fuel line to supply the fuel to the fuel tank at an initial rate of fuel flow, (ii) receive the sensor signal indicating the determined level of ionization, (iii) determine an increased rate of fuel flow based on a difference between the determined level of ionization and a baseline level of ionization, and (iv) cause the fuel line to supply the fuel to the fuel tank at the determined increased rate of fuel flow to reduce a time for supplying the fuel to the fuel tank. The electrostatic charge accumulated on the surface of the fuel dissipates at an increased rate when the determined level of ionization of the air medium is higher than the baseline level of ionization.

In another example, a method of supplying fuel to a fuel tank of a vehicle is described. The method includes determining a level of ionization of an air medium in a fuel tank. The method also includes determining, based on the determined level of ionization, a rate of fuel flow at which to supply the fuel to the fuel tank. The method further includes supplying, via a fuel line, fuel to a fuel tank of a vehicle at the rate of fuel flow. The act of supplying the fuel causes an electrostatic charge to accumulate on a surface of the fuel in the fuel tank. The act of determining the rate of fuel flow includes determining, based on the determined level of ionization, the rate of fuel flow that is configured to maintain the accumulated electrostatic charge below a threshold value. The threshold value is related to a potential for electrical discharge between the surface of the fuel and a structure of the fuel tank due to the accumulated electrostatic charge.

The features, functions, and advantages that have been discussed can be achieved independently in various embodiments or may be combined in yet other embodiments further details of which can be seen with reference to the following description and drawings.

BRIEF DESCRIPTION OF THE FIGURES

The novel features believed characteristic of the illustrative embodiments are set forth in the appended claims. The illustrative embodiments, however, as well as a preferred mode of use, further objectives and descriptions thereof, will best be understood by reference to the following detailed description of an illustrative embodiment of the present disclosure when read in conjunction with the accompanying drawings, wherein:

DETAILED DESCRIPTION

Figure 1:
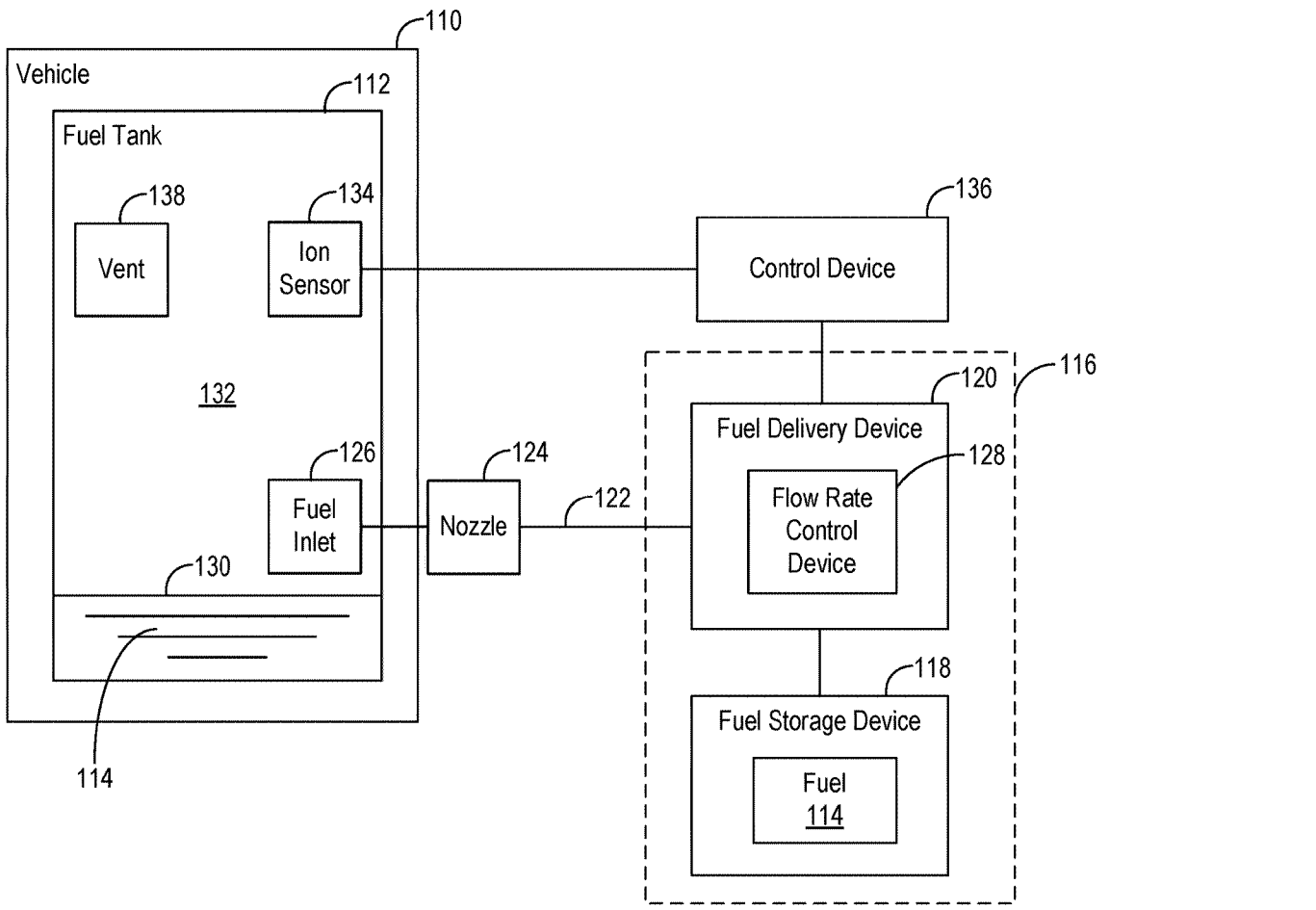
FIG. 1 illustrates a simplified block diagram of a refueling system according to an example embodiment.

Disclosed embodiments will now be described more fully hereinafter with reference to the accompanying drawings, in which some, but not all of the disclosed embodiments are shown. Indeed, several different embodiments may be described and should not be construed as limited to the embodiments set forth herein. Rather, these embodiments are described so that this disclosure will be thorough and complete and will fully convey the scope of the disclosure to those skilled in the art.

The systems and methods of the present disclosure provide refueling systems and methods for supplying fuel to a fuel tank of a vehicle. As noted above, during refueling of the vehicle, the fuel flows in a fuel line from the fuel source to the fuel tank. As the fuel flows in the fuel line, an electrostatic charge may be generated in the fuel due to, among other factors, friction between the fuel and the fuel line. When the fuel is received in the fuel tank, the electrostatic charge may accumulate on the surface of fuel. The accumulated electrostatic charge may present a risk of electrical discharge between the fuel and the fuel tank and, thus, may present safety issues.

Because the fuel has a relatively low conductivity, the accumulated static charge on the surface of the fuel in the fuel tank may dissipate relatively slowly. To mitigate the risk of electrical discharge, existing refueling systems limit a rate of fuel flow in the fuel line so that the accumulated charge remains relatively low. In particular, for example, many refueling systems limit the rate of fuel flow to a rate of fuel flow that is based on an assumption that an air medium in the fuel tank is a non-ionized air medium. However, a non-ionized air medium in the fuel tank dissipates the accumulated electrostatic charge at lower rate of dissipation than an ionized air medium in the fuel tank.

The refueling systems and methods described in the present disclosure can beneficially determine the level of ionization of the air medium in the fuel tank, and determine a rate of fuel flow based on the determined level of ionization. Because the rate of dissipation of the electrostatic charge increases as the level of ionization of the air medium increases, the refueling systems and methods described in the present disclosure can increase the rate of fuel flow while maintaining the accumulated electrostatic charge on the surface of the fuel at or below a relatively safe level. By increasing the rate of fuel flow, the refueling systems and methods described in the present disclosure can reduce a time for supplying the fuel to the fuel tank of the vehicle.

Reducing the time for supplying the fuel to the fuel tank of the vehicle can further provide significant efficiencies for operating transportation facilities. For example, aircraft are generally refueled at airports between flights with an amount of fuel required to complete the aircraft's next flight. To increase the revenue generated by the aircraft, it may be desirable to reduce (or minimize) the amount of time the aircraft spends on the ground between flights. The time spent refueling the aircraft can be a significant contributor to the time required between flights and, thus, it is generally desirable to reduce (or minimize) the amount of time required to refuel the aircraft. Similar considerations may be applicable to other types of vehicles.

Also, within examples, the refueling systems and methods described in the present application provide for increasing the level of ionization of the air medium in the fuel tank of the vehicle. By increasing the level of ionization of the air medium, the rate at which the accumulated electrostatic charge dissipates can be further increased such that the rate of fuel flow also can be increased.

Referring now to FIG. 1, a simplified block diagram of a refueling system 100 for supplying fuel to a fuel tank of a vehicle is depicted according to an example embodiment. As shown in FIG. 1, the refueling system 100 includes a vehicle 110 having a fuel tank 112 for storing fuel 114. Within examples, the vehicle 110 can be an aircraft, a helicopter, an automobile (e.g., a car, a truck, a bus, and/or a van), a railed vehicle (e.g., a train and/or a tram), a watercraft (e.g., a ship and/or a boat), and/or a spacecraft. In an implementation in which the vehicle 110 is an aircraft, the fuel tank 112 can be in a fuselage and/or a wing of the aircraft.

The type of fuel 114 that is stored in the fuel tank 112 can be based, at least in part, on the type of vehicle 110 to be powered by the fuel 114. As examples, the fuel 114 can include aviation gasoline, jet propellant, diesel fuel, and/or automotive gasoline. More generally, the fuel 114 can be any material that can provide energy for operating the vehicle 110.

As also shown in FIG. 1, the refueling system 100 includes a fuel source 116 that can store and deliver the fuel 114 to the fuel tank 112 of the vehicle 110 during a refueling operation. In FIG. 1, the fuel source 116 includes a fuel storage device 118 coupled to a fuel delivery device 120. The fuel storage device 118 stores the fuel 114, which is to be supplied to the fuel tank 112 of the vehicle 110 during the refueling operation. As one example, the fuel storage device 118 can include one or more storage tanks above and/or below ground (e.g., a fuel farm at an airport). The fuel delivery device 120 can couple the fuel storage device 118 to the fuel tank 112 of the vehicle 110 via a fuel line 122. For example, the fuel delivery device 120 can include a fixed refueling system (e.g., a hydrant refueling system) and/or a mobile refueling system (e.g., a refueling truck and/or a tanker aircraft).

The fuel source 116 is coupled to the fuel tank 112 by the fuel line 122. In an example, the fuel line 122 can be a fueling hose having a nozzle 124 for coupling to a fuel inlet 126 of the fuel tank 112. The fuel inlet 126 provides access to an interior space of the fuel tank 112. In an example in which the vehicle 110 is an aircraft, the fuel inlet 126 can be positioned on the aircraft to facilitate over-the-wing refueling and/or under-the-wing refueling. In this arrangement, during a refueling operation, the fuel line 122 can supply the fuel 114 to the fuel tank 112 of the vehicle 110 via the coupling between the nozzle 124 and the fuel inlet 126.

To control the flow of the fuel 114 from the fuel source 116 to the fuel tank 112 of the vehicle 110, the fuel delivery device 120 can include a flow rate control device 128 along the flow path between the fuel storage device 118 and the fuel tank 112. Within examples, the flow rate control device 128 is operable to start, stop, increase, and/or decrease a rate of fuel flow in the fuel line 122. For instance, the flow rate control device 128 can include one or more valves and/or fuel pumps along the flow path between the fuel storage device 118 and the fuel tank 112. The valve(s) and/or fuel pump(s) can be actuatable to start, stop, increase, and/or decrease the rate of fuel flow.

As noted above, the flow of the fuel 114 in the fuel line 122 causes an accumulation of an electrostatic charge on a surface 130 of the fuel 114 in the fuel tank 112. For example, as the fuel 114 flows in the fuel line 122 from the fuel source 116 to the fuel tank 112, friction between the fuel 114 and the fuel line 122 (and/or other components of the fuel source 116 such as, e.g., a filter) generates an electrostatic charge in the fuel 114. When the fuel 114 arrives in the fuel tank 112, the conductivity of the fuel 114 is relatively low and thus the electrostatic charge accumulates on the surface 130 of the fuel 114.

The accumulated electrostatic charge dissipates at a rate of dissipation that is based, at least in part, on a level of ionization of an air medium 132 in the fuel tank 112. For instance, when the air medium 132 has a relatively high level of ionization, the air medium 132 dissipates the accumulated electrostatic charge at a higher rate than when the air medium 132 has a relatively low level of ionization.

The level of ionization of the air medium 132 can be related to an extent of ionizing radiation in an environment proximate to the fuel tank 112. (e.g., in an environment at the location of the fuel tank 112 and/or an environment within a radius of several miles from the fuel tank 112). For example, the decay of naturally occurring terrestrial radioactive materials, radiation from the sun, and/or cosmic radiation can strip electrons from air molecules and thus ionize the environment proximate to the fuel tank 112. Additionally, for example, winds and/or weather fronts can impart friction forces and ionize the air molecules in the environment proximate to the fuel tank 112. Accordingly, the level of ionization of the air medium 132 may naturally vary over time and/or at different locations of the vehicle 110 due to various factors such as those described above.

As noted above, the refueling system 100 is configured to supply the fuel 114 to the fuel tank 112 at a rate of fuel flow that is based on the level of ionization of the air medium 132 in the fuel tank 112. To that end, the refueling system 100 can include an ion sensor 134, which can determine the level of ionization of the air medium 132 in the fuel tank 112 and generate a sensor signal indicating the determined level of ionization. As one example, the ion sensor 134 can include an air ion counter (e.g., a positive ion detector and/or a negative ion detector), which measures the level of ionization of the air medium 132. Additionally, for example, the sensor signal can indicate the determined level of ionization by indicating an ion density of the air medium 132 (e.g., a number of ions per cubic centimeter of air).

In one implementation, the ion sensor 134 can be coupled to an inner wall of the fuel tank 112. In another implementation, the ion sensor 134 can be inserted into the fuel tank 112 during the refueling operation. For example, the ion sensor 134 can be integrated with the nozzle 124 so that the ion sensor 134 is inserted into the fuel tank 112 when the nozzle 124 is coupled to the fuel inlet 126. In another example, the ion sensor 134 can be coupled to the fuel tank 112 separately from the nozzle 124 such as, for instance, via an access port on the inner wall of the fuel tank 112 (which is separate from the fuel inlet 126).

As shown in FIG. 1, the refueling system 100 further includes a control device 136, which is in communication with the fuel delivery device 120 and the ion sensor 134. The control device 136 can receive the sensor signal from the ion sensor 134 and cause the fuel delivery device 120 to supply the fuel 114 through the fuel line 122 at one of a fuel flow rate based on the determined level of ionization indicated by the sensor signal. For example, the flow rate control device 128 and the fuel line 122 can be operable to supply the fuel 114 at a plurality of different rates of fuel flow. The control device 136 can transmit, to the flow rate control device 128, a control signal indicating one of the rates of fuel flow. Responsive to the control signal, the flow rate control device 128 and the fuel line 122 can supply the fuel 114 at the rate of fuel flow indicated by the control signal.

In one implementation, the control device 136 can transmit a first control signal to the fuel delivery device 120 to cause the fuel line 122 to supply the fuel 114 at an initial rate of fuel flow. The initial rate can be a rate of fuel flow that is configured to maintain the accumulated electrostatic charge below a threshold value when the air medium 132 is at a baseline level of ionization. The threshold value can be related to a potential for electrical discharge between the surface 130 of the fuel 114 and a structure of the fuel tank 112 due to the accumulated electrostatic charge. As one example, the initial rate can be configured to maintain the accumulated electrostatic charge below a threshold value of approximately 30 Coulombs per square meter. Additionally, for example, in aviation, the fuel 114 is typically supplied at a rate of fuel flow of approximately 7 feet per second to approximately 10 fee per second (i.e., approximately 2.13 meters per second to approximately 3.05 meters per second), depending on the type of fuel 114, the diameter of the fuel line 122, and/or the composition of the fuel line 122 to maintain the accumulated electrostatic charge below the threshold value at which an electrical discharge may occur. In one implementation, for instance, the initial rate of fuel flow can be approximately 700 gallons per minute to approximately 1000 gallons per minute for a fuel line 122 having a six inch diameter (i.e., a 15.24 centimeter diameter).

In one example, the baseline level of ionization can be a level of ionization of non-ionized air (i.e., approximately no ionization of the air medium 132). As noted above, the rate of dissipation of the accumulated electrostatic charge increases as the level of ionization of the air medium 132 increases. Thus, when the air medium 132 is at the level of ionization of non-ionized air, the rate of dissipation is at or close to a minimum, and the rate of fuel flow should be relatively low to maintain the accumulated electrostatic charge below the threshold value. By basing the initial rate of fuel flow on an assumption that the air medium 132 is non-ionized air, the control device 136 can conservatively cause the fuel line 122 to supply the fuel 114 at a relatively low rate of fuel flow during an initial portion of the refueling operation. This can help to reduce (or eliminate) the risk of the accumulated electrostatic charge reaching the threshold value prior to determining the level of ionization of the air medium 132.

The control device 136 can receive the sensor signal indicating the determined level of ionization, and determine an increased rate of fuel flow based on a difference between the determined level of ionization and the baseline level of ionization. For example, the control device 136 can determine, based on the sensor signal, that the determined level of ionization is higher than the baseline level of ionization. In this scenario, the electrostatic charge accumulated on the surface 130 of the fuel 114 dissipates at an increased rate when the determined level ionization of the air medium 132 is higher than the baseline level of ionization. As such, the rate of fuel flow can be increased while maintaining the accumulated electrostatic charge below the threshold value. This is because the increased accumulation of electrostatic charge (e.g., due to the increased friction at the increased rate of fuel flow) is offset, at least in part, by the higher rate of dissipation of the accumulated electrostatic charge at the determined level of ionization of the air medium 132.

In general, the control device 136 can determine, based on the determined level of ionization, the increased rate such that the accumulated electrostatic charge remains below the threshold value when the fuel line 122 supplies the fuel 114 at the increased rate. In one example, the control device 136 can store in memory and/or access a lookup table, which includes records providing a correspondence between a plurality of levels of ionization and the rates of fuel flow that can be achieved by the fuel delivery device 120 and the fuel line 122. In this example, the control device 136 can determine the increased rate of fuel flow by determining the record in the lookup table that corresponds to the determined level of ionization indicated by the sensor signal.

In another example, the control device 136 can implement an algorithm that outputs the increased rate of fuel flow based on the determined level of ionization and the baseline level of ionization as inputs. For instance, an example algorithm can be in the form of the following equation:

$$R=R_b+K^*(X_i-X_b) \tag{1}$$

where R represents the increased rate of fuel flow, $R_b$ represents the baseline rate of fuel flow, $X_i$ represents the determined level of ionization, $X_b$ represents the baseline level of ionization, and K represents a constant. Constant K depends on geometry of the fuel tank and on the pressure, temperature, and humidity of the air medium.

After the control device 136 determines the increased rate of fuel flow, the control device 136 can cause the fuel line 122 to supply the fuel 114 to the fuel tank 112 at the increased rate of fuel flow to reduce a time for supplying the fuel 114 to the fuel tank 112. For example, the control device 136 can transmit a second control signal to cause the fuel delivery device 120 and the fuel line 122 to supply the fuel 114 at the increased rate of fuel flow.

In general, the control device 136 is a computing device that is configured to control operation of the refueling system 100. As such, the control device 136 can be implemented using hardware, software, and/or firmware. For example, the control device 136 can include one or more processors and a non-transitory computer readable medium (e.g., volatile and/or non-volatile memory) that stores machine language instructions or other executable instructions. The instructions, when executed by the one or more processors, cause the refueling system 100 to carry out the various operations described herein. The control device 136, thus, can receive data (including data indicated by the sensor signal) and store the data in memory (including the lookup table) as well.

Additionally, as shown in FIG. 1, the fuel tank 112 can include a vent 138. The vent 138 can provide for venting a portion of the air medium 132 out of the fuel tank 112 while the fuel line 122 supplies the fuel 114 into the fuel tank 112. The vent 138 can thus help to relieve a pressure in the fuel tank 112 and thereby facilitate supplying the fuel 114 at the rate of fuel flow determined by the control device 136. Within examples, the vent 138 can be at an elevated location relative to the surface 130 of the fuel 114 in the fuel tank 112.

In the example described above, the baseline level of ionization was that of non-ionized air. In another example, the baseline level of ionization can be a relatively low level of ionization based on, for instance, the type of vehicle 110 and/or a location of the vehicle 110. For example, the baseline level of ionization can be approximately 1000 ions per cubic centimeter of air to approximately 2000 ions per cubic centimeter of air. More generally, the baseline level of ionization can be an assumed level of ionization that is expected to be below the actual level of ionization that will be determined by the ion sensor 134. In this way, the control device 136 can initially start supplying the fuel 114 at a relatively conservative rate of fuel flow and then increase the rate of fuel flow based on the determined level of ionization of the air medium 132. The baseline level of ionization can be based on, for example, past historical measurements of levels of ionization at the particular refueling location of the vehicle 110, the type of vehicle 110 that will be refueled, terrestrial weather (e.g. wind blowing from an ocean may have relatively low ionization but wind blowing down from a mountain range may have relatively high ionization), and current solar weather (e.g. low solar activity increases the flux of cosmic rays striking the earth, which increases the level of ionization).

Figure 2:
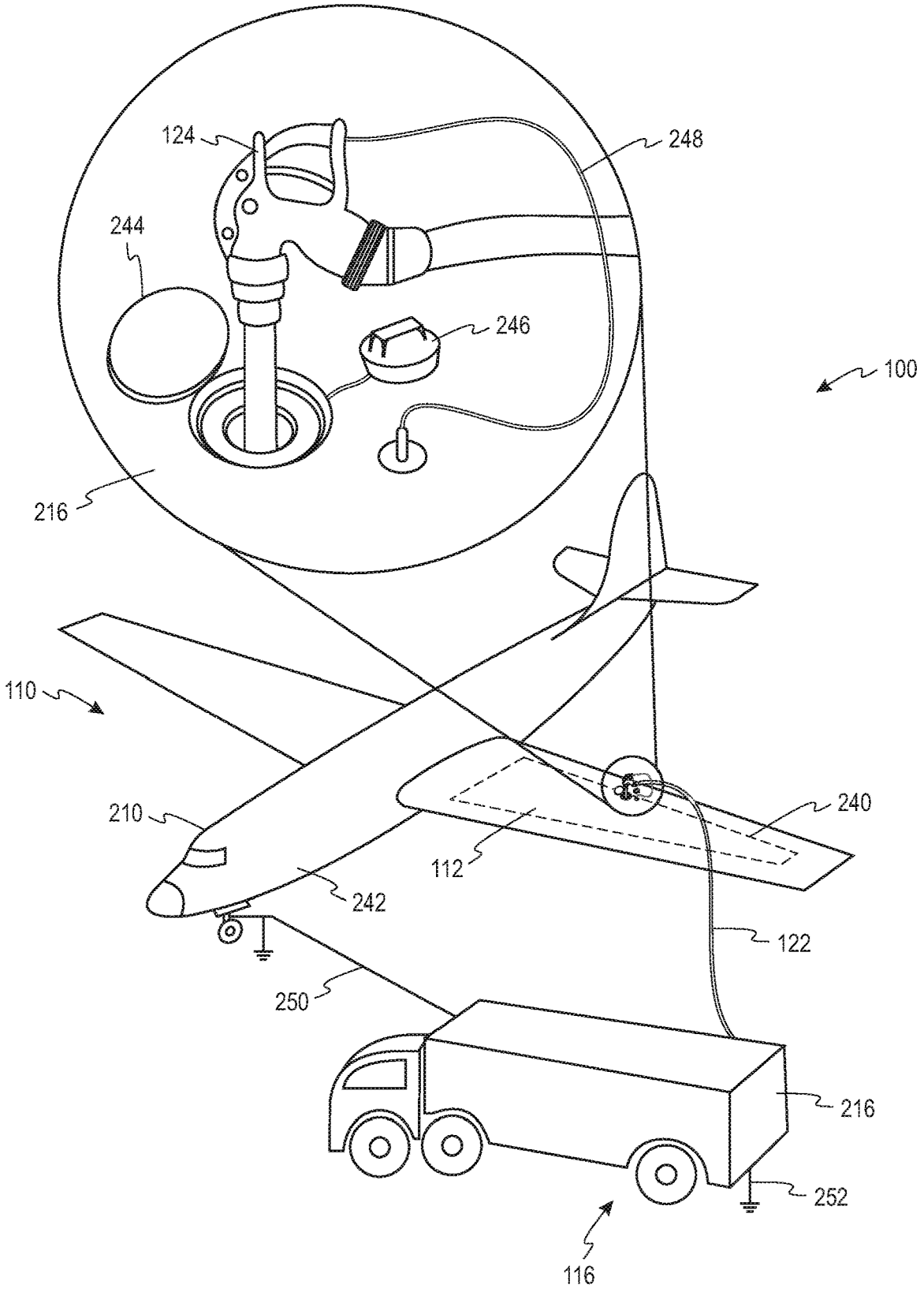
FIG. 2 illustrates a perspective view of the refueling system shown in FIG. 1 according to an example embodiment.

FIG. 2 depicts a perspective view of the refueling system 100 during a refueling operation in accordance with an example embodiment. In FIG. 2, the vehicle 110 is an aircraft 210 and the fuel source 116 is a fuel truck 216; however, the vehicle 110 and the fuel source 116 can take other forms in alternative examples. The aircraft 210 includes the fuel tank 112 in a wing 240, which is coupled to a fuselage 242 of the aircraft 210. The fuel tank 112 can additionally or alternatively be located in the fuselage 242 of the aircraft 210.

As shown in FIG. 2, the fuel source 116 is coupled to the aircraft 210 via the fuel line 122. For example, in FIG. 2, the fuel inlet 126 can be accessed by opening a fuel cover 244 over the fuel inlet 126 and removing a cap 246. With the fuel cover 244 opened and the cap 246 removed, the nozzle 124 is inserted into the fuel inlet 126 to couple the fuel line 122 to the fuel tank 112. After refueling is completed, the cap 246 can be coupled to the fuel inlet 126 to facilitate sealing the fuel inlet 126, and the fuel cover 244 can be closed. The fuel cover 244 and the cap 246 can thus help to protect the fuel tank 112 when the fuel 114 is not being supplied to the fuel tank 112.

Additionally, as shown in FIG. 2, the refueling system 100 includes a plurality of electrical conductors 248, 250, 252 for providing a conductive path to equalize the electrical potential between the fuel source 116 and the vehicle 110. For example, a first electrical conductor 248 electrically couples the nozzle 124 to the aircraft 210, a second electrical conductor 250 electrically couples the fuel truck 216 to the aircraft 210, and a third electrical conductor 252 electrically couples the fuel truck 216 to a ground (e.g., a grounding post). The second electrical conductor 250 can also be coupled to the ground. Equalizing the electrical potential between the aircraft 210, the fuel truck 216, and the nozzle 124 using the electrical conductors 248, 250, 252 can reduce the risk of a discharge of the electrostatic charge, which accumulates while supplying the fuel 114 from the fuel truck 216 to the aircraft 210.

In the examples described above, the refueling system 100 can increase the rate of fuel flow based on the determined level of ionization of the air medium 132 in the fuel tank 112 being higher than the baseline level of ionization. As described above, the determined level of ionization of the air medium 132 may be higher than the baseline level of ionization due to, for example, an extent of ionizing radiation in the environment proximate to the fuel tank 112. Thus, in the example above, the refueling system 100 can beneficially increase the rate of fuel flow based naturally occurring conditions at the time of refueling allowing for the increased rate of fuel flow while maintaining a relatively low risk of electrical discharge.

In additional or alternative examples, the refueling system 100 can facilitate increasing the level of ionization of the air medium 132 in the fuel tank 112. By increasing the level of ionization of the air medium 132 in the fuel tank 112, the refueling system 100 can further increase the rate at which the accumulated electrostatic charge dissipates from the surface 130 of the fuel 114. Accordingly, increasing the level of ionization of the air medium 132 can facilitate the refueling system 100 providing for greater increases to the rate of fuel flow while maintaining the accumulated electrostatic charge below the threshold value during a refueling operation.

Figure 3A:
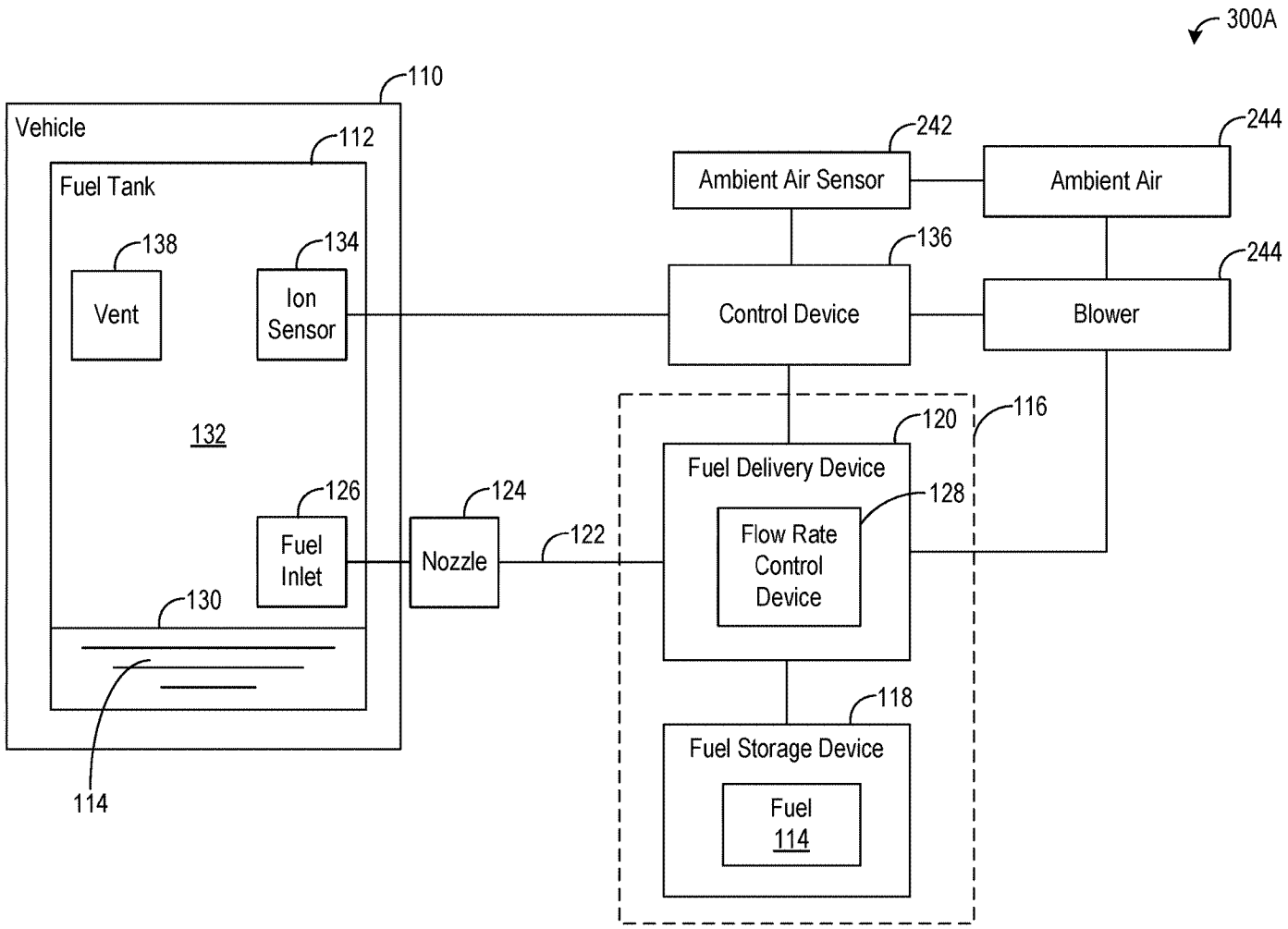
FIG. 3A illustrates a simplified block diagram of a refueling system according to an example embodiment.
Figure 3B:
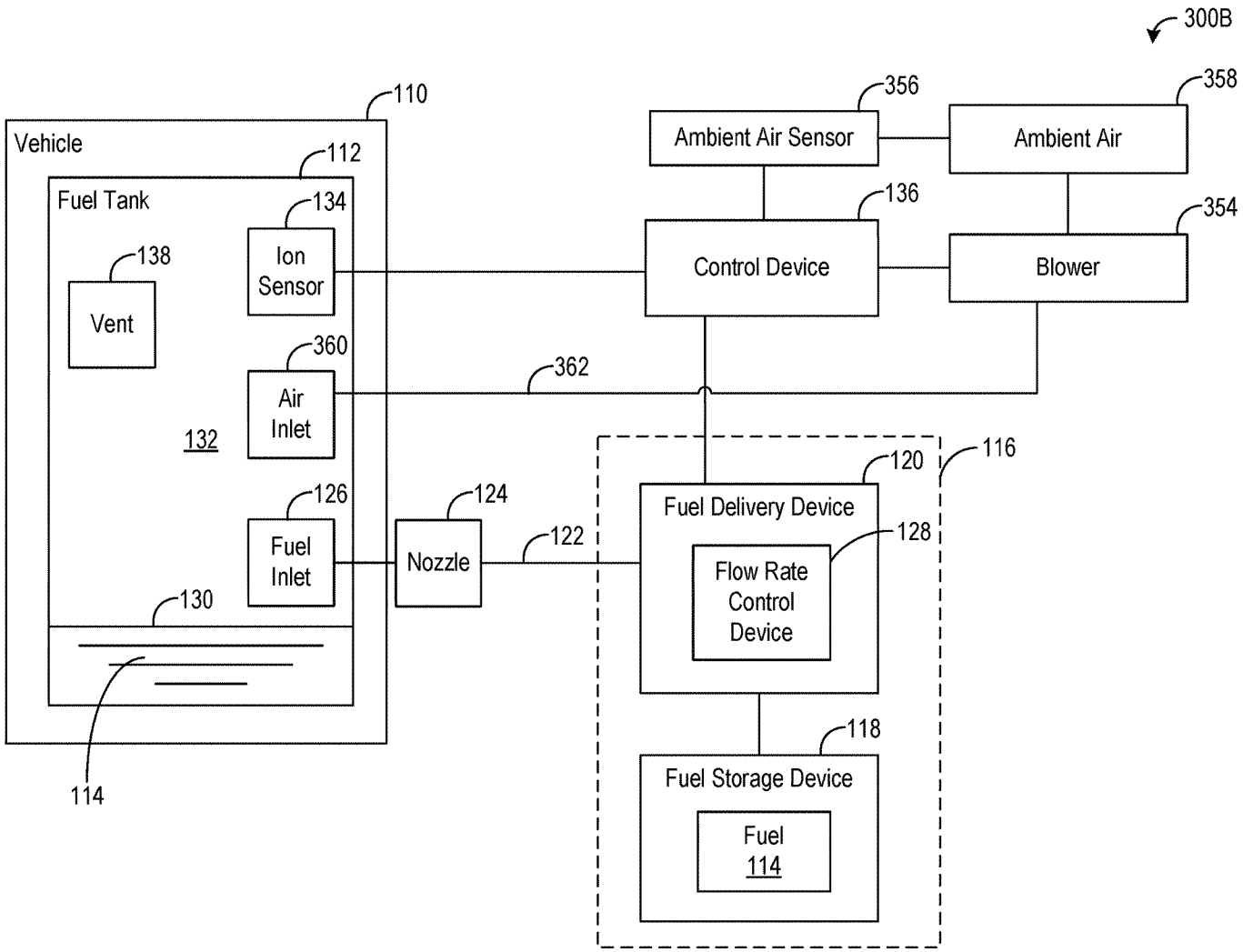
FIG. 3B illustrates a simplified block diagram of a refueling system according to an example embodiment.

FIG. 3A and FIG. 3B depict simplified block diagrams of refueling systems 300A, 300B for increasing the level of ionization of the air medium 132 and supplying the fuel 114 to the fuel tank 112 of the vehicle 110 according to example embodiments. As shown in FIGS. 3A-3B, the refueling systems 300A, 300B include the vehicle 110, the fuel tank 112, the fuel 114 having the surface 130, the fuel source 116, the fuel storage device 118, the fuel delivery device 120, the fuel line 122, the nozzle 124, the fuel inlet 126, the flow rate control device 128, the air medium 132 in the fuel tank 112, the ion sensor 134, the control device 136, and the vent 138 arranged and configured as described above.

Additionally, as shown in FIGS. 3A-3B, the refueling systems 300A, 300B include a blower 354 and an ambient air sensor 356 in communication with the control device 136. The blower 354 can supply, from an environment external to the fuel tank 112, ambient air 358 into the fuel tank 112. As examples, the blower 354 can include one or more centrifugal blowers, positive displacement blowers, air compressors, and/or air flow dampers.

In FIG. 3A, the blower 354 is coupled to the fuel delivery device 120. In this arrangement, the fuel delivery device 120 can receive the ambient air 358 from the blower 354 and supply a mixture of the ambient air 358 and the fuel 114 to the fuel tank 112 via the fuel line 122. Whereas, in FIG. 3B, the blower 354 is configured to supply the ambient air 358 to the fuel tank 112 separately from the fuel 114 in the fuel line 122. For example, in FIG. 3B, the blower 354 is coupled to an air inlet 360 of the fuel tank 112 via an air line 362. Supplying the ambient air 358 via the fuel line 122 (e.g., as shown in FIG. 3A) can reduce the number of inlets 126, 360 to the fuel tank 112. Whereas, supplying the ambient air 358 via separate air line 362 (e.g., as shown in FIG. 3B) can simplify the fuel delivery device 120.

In FIGS. 3A-3B, the vent 138 can vent a portion of the air medium 132 out of the fuel tank 112 while the blower 354 supplies the ambient air 358 into the fuel tank 112 (e.g., via the fuel delivery device 120 and/or the air line 362). This can facilitate relieving pressure in the fuel tank 112 while supplying the fuel 114 and the ambient air 358 into the fuel tank 112. Venting the air medium 132 while supplying the ambient air 358 to the fuel tank 112 can also help to increase the level of ionization of the air medium 132 as the vented air medium 132 is replaced by the supplied ambient air 358.

The ambient air sensor 356 can determine a level of ionization of the ambient air 358 in the environment external to the fuel tank 112 and transmit to the control device 136 an ambient-air signal indicating the determined level of ionization of the ambient air 358. For example, the ambient air sensor 356 can include an ion counter, which can measure an ion density of the ambient air 358. Based on the ambient-air signal received from the ambient air sensor 356 and the sensor signal received from the ion sensor 134, the control device 136 can determine that the determined level of ionization of the air medium 132 in the fuel tank 112 is less than the determined level of ionization of the ambient air 358. In such instances, it can be beneficial to supply the ambient air 358 into the fuel tank 112 to increase the level of ionization of the air medium 132 in the fuel tank 112 and thus increase the rate for dissipating the accumulated electrostatic charge on the surface 130 of the fuel 114.

Accordingly, responsive to a determination that the determined level of ionization is less than the level of ionization of the ambient air, the control device 136 can cause the blower 354 to supply the ambient air 358 into the fuel tank 112 to increase the level of ionization of the air medium 132 in the fuel tank 112. By increasing the level of ionization of the air medium 132 using the ambient air 358, the refueling systems 300A-300B can increase the rate for dissipating the electrostatic charge accumulated on the surface 130 of the fuel 114. This in turn allows for the control device 136 to increase the rate of fuel flow by greater magnitudes while maintaining the accumulated electrostatic charge below the threshold amount.

In one implementation, the control device 136 can iteratively repeat (i) causing the blower 354 to supply the ambient air 358 and increase the level of ionization of the air medium 132 in the fuel tank 112, (ii) receiving, from the ion sensor 134, the sensor signal indicating the determined level of ionization of the air medium 132, (iii) determining the increased rate of fuel flow based on the determined level of ionization, and (iv) causing the fuel line 122 to supply the fuel 114 at the increased rate of fuel flow one or more times to iteratively increase the increased rate of fuel flow and further reduce the time for supplying the fuel 114 to the fuel tank 112 during the refueling operation.

Figure 4:
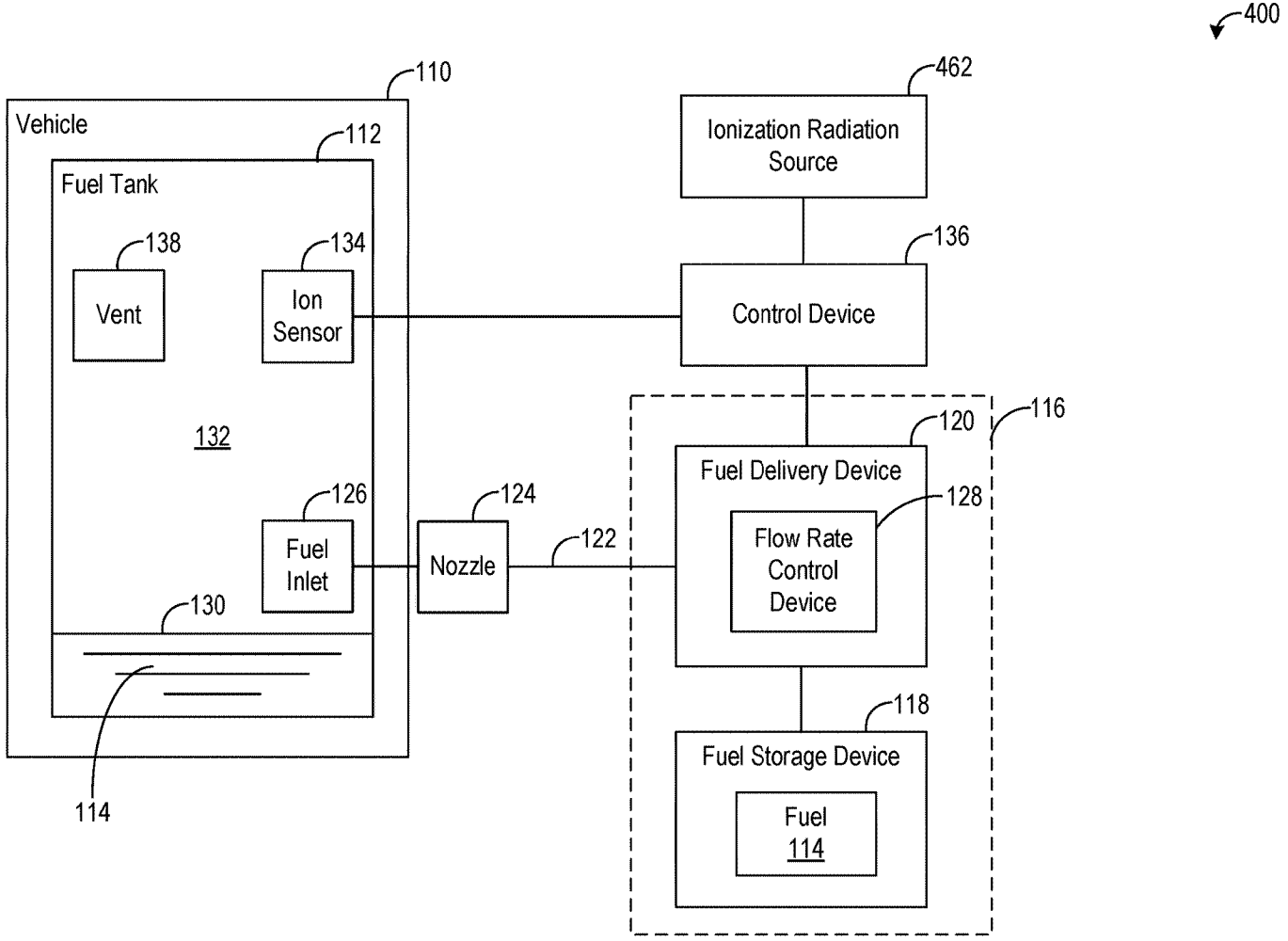
FIG. 4 illustrates a simplified block diagram of a refueling system according to an example embodiment.

FIG. 4 depicts a refueling system 400 for increasing the level of ionization of the air medium 132 and supplying the fuel 114 to the fuel tank 112 of the vehicle 110 according to another example embodiment. As shown in FIG. 4, the refueling system 400 includes the vehicle 110, the fuel tank 112, the fuel 114 having the surface 130, the fuel source 116, the fuel storage device 118, the fuel delivery device 120, the fuel line 122, the nozzle 124, the fuel inlet 126, the flow rate control device 128, the air medium 132 in the fuel tank 112, the ion sensor 134, the control device 136, and the vent 138 arranged and configured as described above.

Additionally, as shown in FIG. 4, the refueling system 400 includes an ionization radiation source 462 in communication with the control device 136. The ionization radiation source 462 can expose the air medium 132 in the fuel tank 112 to ionizing radiation to increase the level of ionization of the air medium 132 in the fuel tank 112 and thereby increase the rate of dissipation of the electrostatic charge accumulated on the surface 130 of the fuel 114. As examples, the ionizing radiation can be at least one of x-ray radiation, gamma ray radiation, alpha particles, or beta particles.

Figure 5:
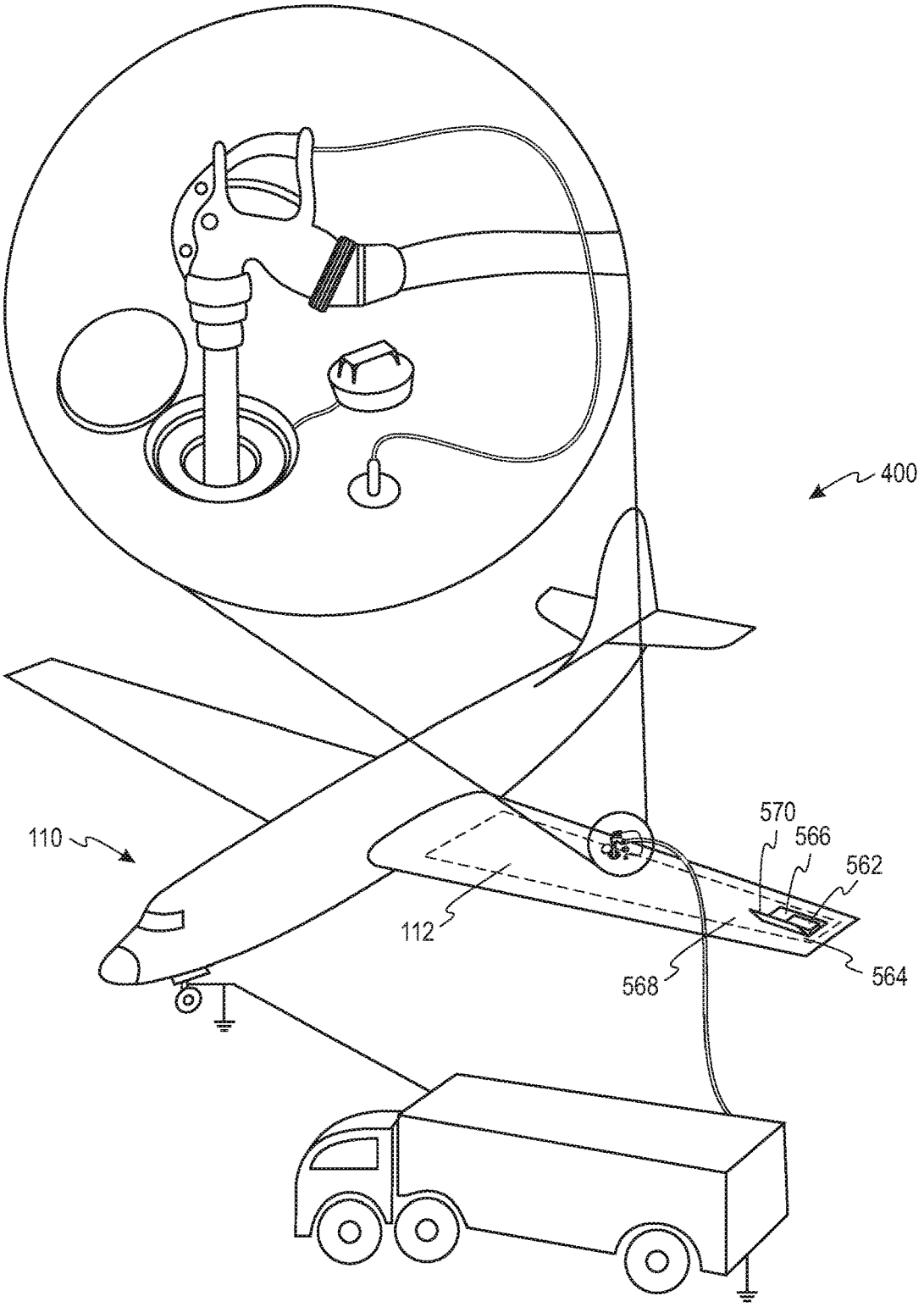
FIG. 5 illustrates a perspective view of the refueling system shown in FIG. 4 according to an example embodiment.

In one example, the ionization radiation source 462 can transmit the ionizing radiation to the air medium 132 in the fuel tank 112 through a surface of the vehicle 110 and the fuel tank 112. FIG. 5 depicts a perspective view of the refueling system 400 during a refueling operation for one implementation of this example. In FIG. 5, the ionization radiation source 462 is depicted as a portable x-ray radiation source 562 positioned on a surface 564 of the vehicle 110 adjacent to the fuel tank 112. While positioned on the surface 564 of the vehicle 110, the portable x-ray radiation source 562 can transmit x-ray radiation through the surface 564 of the vehicle 110 to the air medium 132 in the fuel tank 112.

In FIG. 5, the vehicle 110 includes a designated area for positioning the portable x-ray radiation source 562 (or another ionization radiation source 462). More particularly, the portable x-ray radiation source 562 is positioned on a window portion 566 of the surface 564 of the vehicle 110. The window portion 566 has a higher x-ray radiation transmissivity than a portion 568 of the surface 564 of the vehicle 110 adjacent to the window portion 566. For example, the window portion 566 can be thinner than the portion 568 adjacent to the window portion 566, and/or the window portion 566 can be made from a different material than the portion 568 adjacent to the window portion 566.

Additionally, the vehicle 110 includes a window cover 570, which is actuatable between an open state and a closed state. In the open state, the window cover 570 provides access to the window portion 566. Whereas, in the closed state, the window cover 570 inhibits access to the window portion 566. In the closed state, the window cover 570 can thus protect the window portion 566 before and/or after the refueling operation. For instance, when the window cover 570 is closed the thickness of the surface 564 at the window portion 566 is increased and, thus, a combination of the window cover 570 and the window portion 566 can provide a lower x-ray radiation transmissivity into the fuel tank 112 when the window cover 570 is closed than the x-ray transmissivity of the window portion 566 alone when the window cover 570 is open.

Figure 6A:
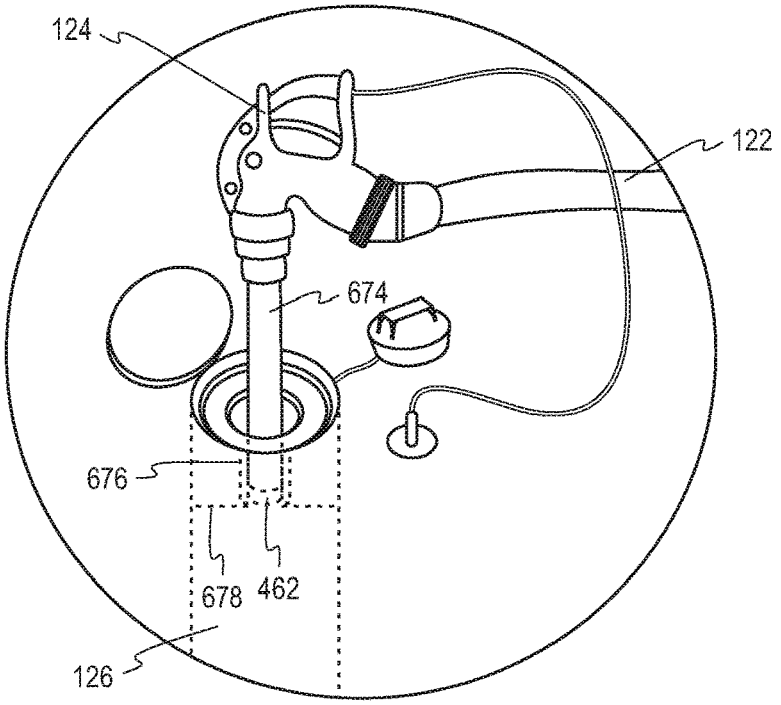
FIG. 6A illustrates a perspective view of a nozzle and an ionization radiation source in a first position according to an example embodiment.
Figure 6B:
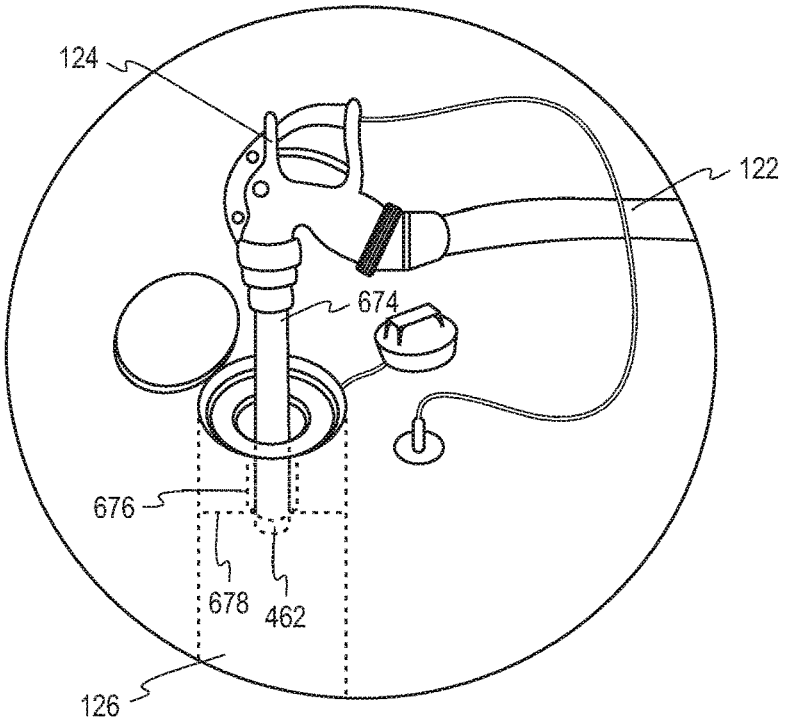
FIG. 6B illustrates a perspective view of the nozzle and the ionization radiation source in second position according to the example embodiment shown in FIG. 6A.

In additional or alternative examples, the nozzle 124 of the fuel line 122 can include the ionization radiation source 462. In such examples, the ionization radiation source 462 can expose the air medium 132 to the ionizing radiation when the nozzle 124 is coupled to the fuel inlet 126. FIGS. 6A-6B depict an example in which the nozzle 124 includes the ionization radiation source 462. As shown in FIGS. 6A-6B, the fuel line 122 is coupled to the fuel inlet 126 via the nozzle 124. The nozzle 124 includes a handle 672 and a spout 674 extending from the handle 672. The handle 672 can facilitate handling of the nozzle 124 by an operator, and the spout 674 can facilitate coupling the nozzle 124 to the fuel inlet 126.

Also, as shown in FIGS. 6A-6B, the ionization radiation source 462 is coupled to the spout 674 of the nozzle 124. As such, when the spout 674 is inserted in the fuel inlet 126, the ionization radiation source 462 can extend into and/or directly access the fuel tank 112. In this way, the ionization radiation source 462 can expose the air medium 132 in the fuel tank 112 to the ionizing radiation transmitted by the ionization radiation source 462. Although the ionization radiation source 462 is on an end of the spout 674 in FIGS. 6A-6B, the ionization radiation source 462 can be additionally or alternatively coupled to a different portion of the nozzle 124 in another example.

In FIGS. 6A-6B, the nozzle 124 also includes a retractable shield 676 on the spout 674. The retractable shield 676 can limit exposure to the ionizing radiation from the ionization radiation source 462 when the nozzle 124 is decoupled from the fuel tank 112. This can beneficially provide additional protection to operators and equipment in the vicinity of the nozzle 124. Within examples, the retractable shield 676 can be made from one or more materials that inhibit and/or block the ionizing radiation transmitted by the ionization radiation source 462 such as, for instance, lead, depleted uranium, thorium, and/or barium sulfate.

The retractable shield 676 is actuatable between a first position in which the retractable shield 676 covers the ionization radiation source 462, and a second position in which the retractable shield 676 retracts from the ionization radiation source 462. The retractable shield 676 can be in the first position when the nozzle 124 is decoupled from the fuel tank 112, and the retractable shield 676 can be in the second position when the nozzle 124 is coupled to the fuel inlet 126 of the fuel tank 112. Accordingly, prior to inserting the nozzle 124 into the fuel tank 112, the retractable shield 676 can limit exposure to the ionizing radiation from the ionization radiation source 462. Whereas, when the nozzle 124 is inserted into the fuel tank 112, the retractable shield 676 can expose the ionization radiation source 462 to transmit the ionizing radiation to the air medium 132 in the fuel tank 112.

As one example, the retractable shield 676 can be actuated between the first position and the second position by an engagement between the retractable shield 676 and a portion of the fuel inlet 126. For instance, in FIGS. 6A-6B, the fuel inlet 126 includes a shoulder portion 678, which is configured to engage with the retractable shield 676 when the nozzle 124 is inserted in the fuel inlet 126. In FIG. 6A, the spout 674 is partially inserted in the fuel inlet 126. As shown in FIG. 6A, the retractable shield 676 does not engage the shoulder portion 678 and, thus, the retractable shield 676 is in the first position covering the ionization radiation source 462.

In FIG. 6B, the spout 674 is fully inserted in the fuel inlet 126. While inserting the spout 674 from the partially-inserted position shown in FIG. 6A to the fully-inserted position shown in FIG. 6B, the retractable shield 676 engages the shoulder portion 678 and retracts away from the ionization radiation source 462. Accordingly, in FIG. 6B, the retractable shield 676 is in the second position exposing the ionization radiation source 462. In one implementation, the retractable shield 676 can be spring-biased towards the first position so that the retractable shield 676 returns to the first position covering the ionization radiation source 462 when the nozzle 124 is decoupled from the fuel inlet 126 of the fuel tank 112.

Figure 7:
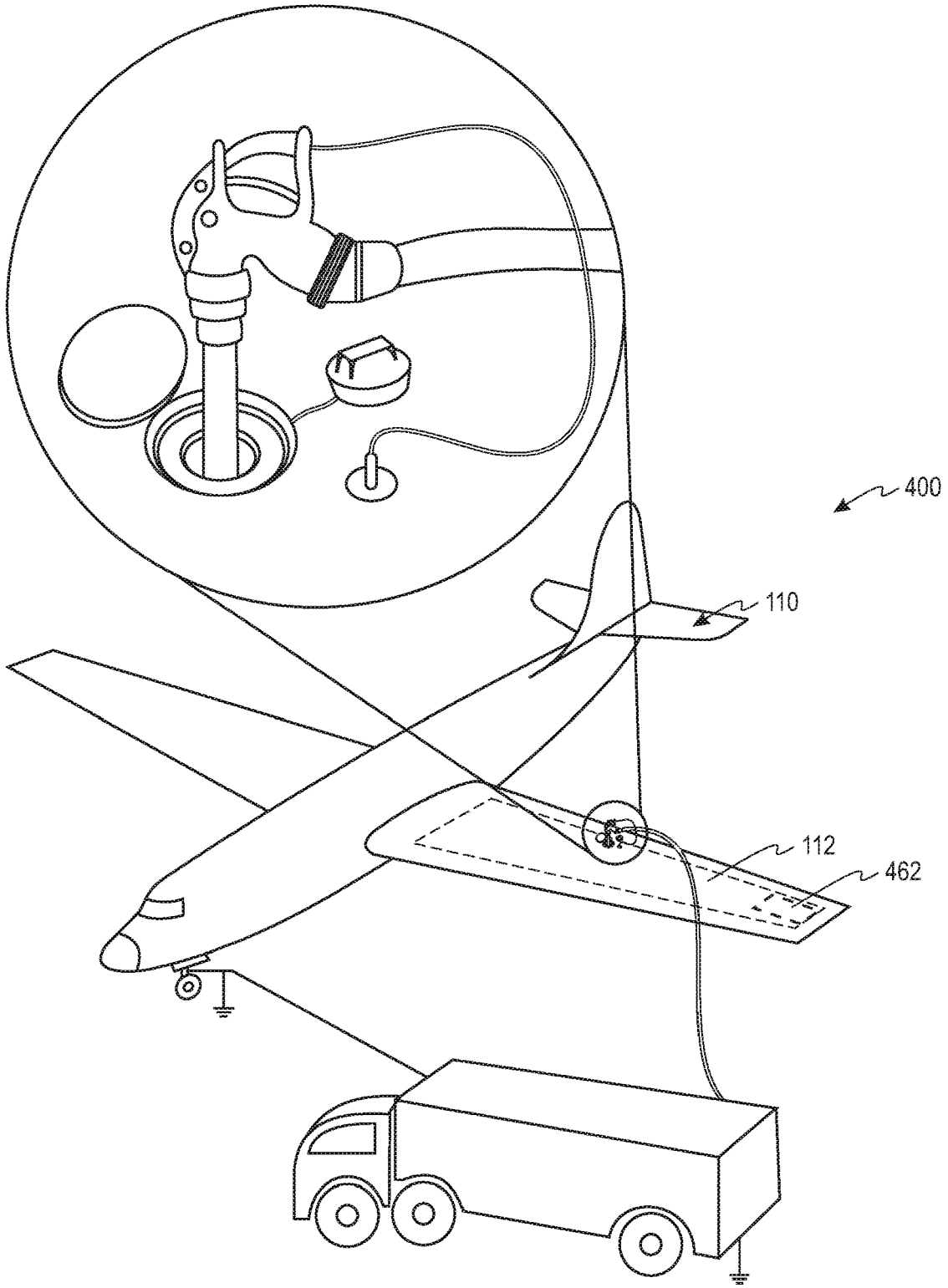
FIG. 7 illustrates a perspective view of the refueling system shown in FIG. 4 according to an example embodiment.

In an additional or alternative example, the ionization radiation source 462 can be in the fuel tank 112. FIG. 7 depicts the refueling system 400 during a refueling operation for one implementation of this example. As shown in FIG. 7, the ionization radiation source 462 is in the fuel tank 112 of the vehicle 110. For example, the ionization radiation source 462 can be coupled to an inner wall of the fuel tank 112. By locating the ionization radiation source 462 in the fuel tank 112, the ionization radiation source 462 can directly transmit the ionizing radiation to the air medium 132 in the fuel tank 112. Additionally, locating the ionization radiation source 462 in the vehicle 110 can facilitate more rapidly increasing the level of ionization of the air medium 132 as compared to examples in which the ionization radiation source 462 is coupled to the vehicle 110 during the refueling operation (e.g., as described above with respect to FIGS. 5-6B and below with respect to FIG. 8).

Figure 8:
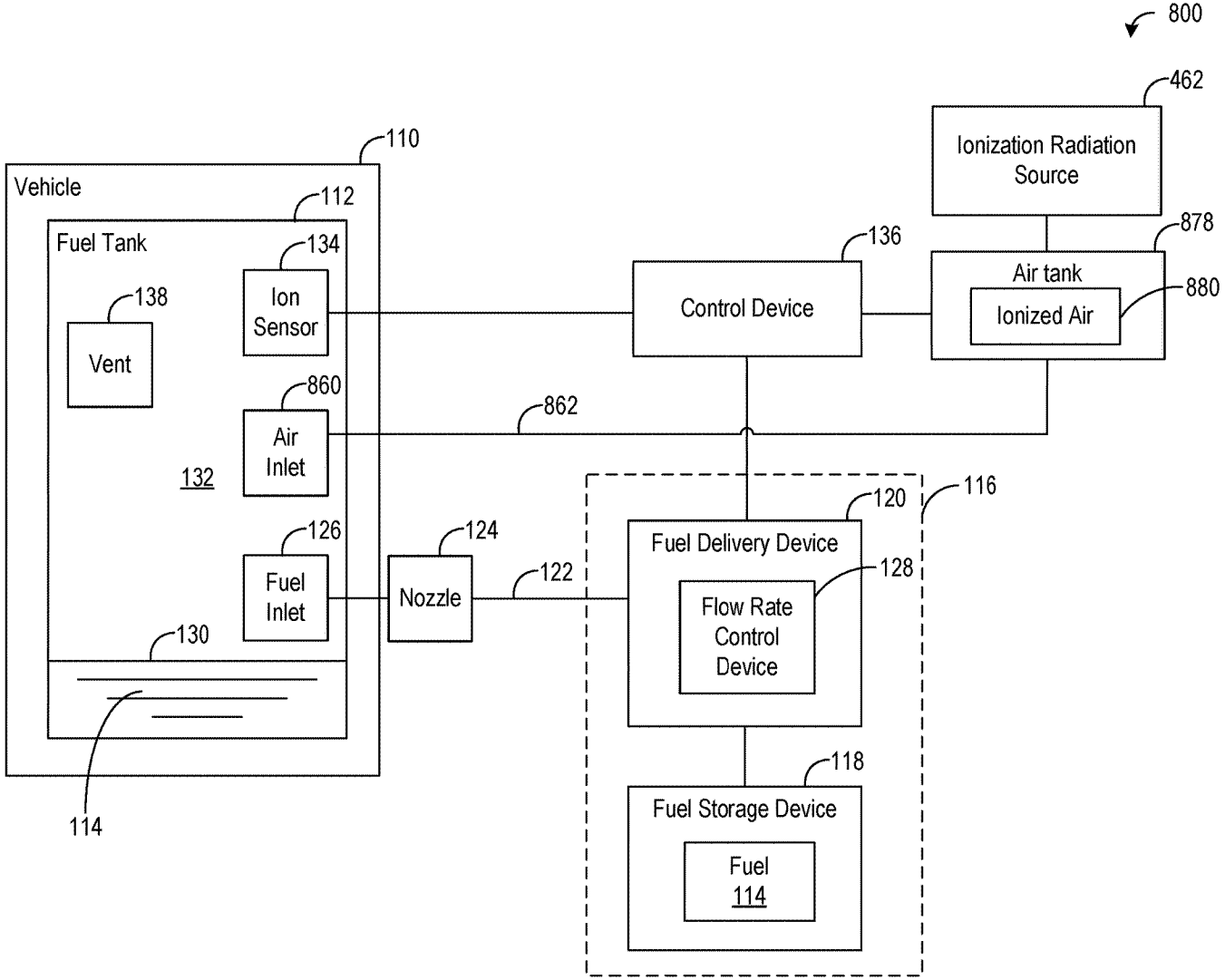
FIG. 8 illustrates a simplified block diagram of a refueling system according to an example embodiment.

Also, in additional or alternative examples, the ionization radiation source 462 can increase the level of ionization of the air medium 132 by forming ionized air in an air tank external to the fuel tank 112, and then supplying the ionized air from the air tank into the fuel tank 112. FIG. 8 depicts a simplified block diagram of a refueling system 800 including an air tank 878 for supplying ionized air to the fuel tank 112 to increase the level of ionization of the air medium 132. As shown in FIG. 8, the refueling system 800 includes the vehicle 110, the fuel tank 112, the fuel 114 having the surface 130, the fuel source 116, the fuel storage device 118, the fuel delivery device 120, the fuel line 122, the nozzle 124, the fuel inlet 126, the flow rate control device 128, the air medium 132 in the fuel tank 112, the ion sensor 134, the control device 136, and the vent 138 arranged and configured as described above.

Additionally, as shown in FIG. 8, the refueling system 800 includes the ionization radiation source 462, the air tank 878, an air line 862, and an air inlet 860. The air tank 878 is coupled the air inlet 860 of the fuel tank 112 via the air line 862. The ionization radiation source 462 can expose air in the air tank 878 to the ionizing radiation to form ionized air 880. For example, as described above, the ionization radiation source 462 can transmit at least one of one of x-ray radiation, gamma ray radiation, alpha particles, or beta particles to the air in the air tank 878 to form the ionized air 880. As another example, the ionization radiation source 462 can supply a radioactive gas into the air tank 878 to form the ionized air 880.

As yet another example, the ionization radiation source 462 can include a sparker in the air tank 878. In one implementation, the sparker can include a plurality of electrodes separated by a relatively small gap. When activated, the sparker can generate a spark, which can form plasma and, thus, the ionized air 880 in the air tank 878.

Responsive to the ionization radiation source 462 forming the ionized air 880 in the air tank 878, the air tank 878 can supply the ionized air 880 to the fuel tank 112 via the air line 862 and the air inlet 860. In FIG. 8, the air tank 878 is in communication with the control device 136. In this example, the control device 136 can transmit a control signal to the air tank 878 to control the supply of the ionized air 880 into the fuel tank 112. In another example, the air tank 878 can be manually operated to supply the ionized air 880 into the fuel tank 112.

Although the air tank 878 is coupled to the fuel tank 112 via the air line 862 and the air inlet 860, the air tank 878 can be coupled to the fuel delivery device 120 in an additional or alternative example. In this example, the air tank 878 can supply the ionized air 880 to the fuel delivery device 120 and the fuel delivery device 120 can then supply a mixture of the ionized air 880 and the fuel 114 to the fuel tank 112 via the fuel line 122.

In the examples described above, the refueling systems 100, 300A, 300B, 400, and 800 include an ion sensor 134 that can measure the level of ionization of the air medium 132 in the fuel tank 112. In another example, the refueling systems 100, 300A, 300B, 400, and 800 can additionally or alternatively calculate the level of ionization of the air medium 132 in the fuel tank 112. More generally, the refueling systems 100, 300A, 300B, 400, and 800 can determine the level of ionization of the air medium 132 by measuring or calculating the level of ionization of the air medium 132, and then use the determined level of ionization of air medium 132 as a basis for determining and/or increasing the rate of fuel flow.

In one example, the control device 136 can calculate the level of ionization of the air medium 132 in the fuel tank 112 by (a) calculating the types and average concentrations of radioisotopes in ambient air along various flight segments since the last fueling (e.g., one segment may be "cruise 4,000 miles at 37,000 feet over the mid-Pacific ocean on May 3, 2017" or "climb eastward from Boston to 12,000 feet on Jun. 12, 2017"), (b) calculating an amount of air drawn into the fuel tank 112 during each flight segment, (c) computing an amount of each radioisotope remaining in the air medium 132, given the decay rate of each radioisotope and the elapsed time since each flight segment, (d) calculating a power level of ionizing radiation produced by the total amount of radioisotope (e.g. 0.2 watts of radioactive decay), (e) dividing the power level of ionizing radiation by 33 electron volts, which is the average energy lost by an ionizing particle per ion pair created in a gas, (f) multiplying by two to calculate the rate of ion production in the air medium (each ion pair has one positive and one negative ion), (g) dividing by the volume of the fuel tank 112 to calculate a rate of ion production per unit volume of air medium, and (h) dividing by the mean lifetime $\lambda_1$ of an ion in the air medium in the tank, which is a measurable or calculable function of the tank size, the tank geometry, and the amount of fuel in the tank. Within examples, the types and average concentrations of radioisotopes in ambient air can be calculated from the recent history of a given body of air, such as time near a geologic region with abundant granite or shale (prominent sources of radon-222 which has half-life if 4 days) or at high altitude and high latitude (heavily exposed to cosmic radiation which produces a variety of radioisotopes). Also, within examples, the recent history of a given body of air can be estimated from meteorological data, e.g. wind measurements and vertical mixing measurements.

In another example in which the blower 354 increases the level of ionization, the control device 136 can calculate the level of ionization of the air medium 132 by (a) calculating the average concentration of radon-222 in ambient air, (b) calculating the amount of air blown into the fuel tank 112 by the blower 354 operating for a given period of time, (c) calculating the amount of radon-222 remaining in the air medium given the 4-day half-life of radon-222 and the elapsed time since the blower 354 was active, (d) computing the power level of ionizing radiation produced by the total amount of radon-222 and its shorter-lived decay products, (e) dividing this power level by 33 electron volts, which is the average energy lost by an ionizing particle per ion pair created in a gas, (f) multiplying by two to calculate the rate of ion production in the air medium (each ion pair has one positive and one negative ion), (g) dividing by a volume of the fuel tank 112 to get rate of ion production per unit volume of air medium 132, and (h) dividing by the mean lifetime $\lambda_1$ of an ion in the air medium 132 in the fuel tank 112, which is a measurable or calculable function of a size of the fuel tank 112, a geometry of the fuel tank 112, and/or an amount of fuel 114 in the fuel tank 112. The average concentration of radon-222 in ambient air can be measured and/or calculated from a recent history of a given body of air, such as time near a geologic region with abundant granite or shale (prominent sources of radon-222).

In yet another example in which the ionization radiation source 462 increases the level of ionization, the control device 136 can calculate the level of ionization of the air medium 132 by (a) calculating the power level of ionizing radiation produced by ionization radiation source 462 (e.g. 5 watts of x-ray output) that enters the air medium 132, (b) dividing this power level by 33 electron volts, which is the average energy lost by an ionizing particle per ion pair created in a gas, (c) multiplying by two to calculate the rate of ion production in the air medium 132 (each ion pair has one positive and one negative ion), (d) dividing by the volume of the fuel tank 112 to get rate of ion production per unit volume of air medium 132, and (e) dividing by the mean lifetime $\lambda$ of an ion in the air medium 132 in the fuel tank 112, which is a measurable and/or calculable function of the size of the fuel tank 112, the geometry of the fuel tank 112, the amount of fuel 114 in the fuel tank 112, and/or the location and orientation of ionization radiation source 462.

In operation, a refueling operation can begin by coupling the electrical conductors 248, 250, 252 to bond the vehicle 110 and the fuel source 116. This equalizes the electrical potential between the vehicle 110 and the fuel source 116 and thereby reduces the risk of an electrical discharge while supplying the fuel 114 from the fuel source 116 to the fuel tank 112 of the vehicle 110.

After bonding the vehicle 110 and the fuel source 116, the control device 136 can transmit a control signal to the fuel delivery device 120 to cause the fuel line 122 to supply the fuel 114 to the fuel tank 112 of the vehicle 110 at the initial rate of fuel flow. As noted above, supplying the fuel 114 causes an electrostatic charge to accumulate on the surface 130 of the fuel 114 in the fuel tank 112. Also, as noted above, the control device 136 can determine the initial rate of fuel flow to be a rate of fuel flow, which maintains the accumulated electrostatic charge below the threshold value when the air medium 132 is at the baseline level of ionization.

Before and/or while supplying the fuel 114 at the initial rate of fuel flow, the ion sensor 134 determines the level of ionization of the air medium 132 in the fuel tank 112 and transmits the sensor signal to the control device 136. The control device 136 receives, from the ion sensor 134, the sensor signal indicating the determined level of ionization of the air medium 132. Additionally or alternatively, before and/or while supplying the fuel 114 at the initial rate of fuel flow, the control device 136 performs calculations to determine the level of ionization.

The control device 136 then determines the increased rate of fuel flow based on a difference between the determined level of ionization and the baseline level of ionization. For example, the control device 136 can determine, based on the determined level of ionization, the increased rate such that the accumulated electrostatic charge remains below the threshold value when supplying the fuel at the increased rate. For instance, the control device 136 can use the lookup table and/or the algorithm stored in memory to determine the increased rate of fuel flow. The control device 136 can then transmit another control signal to the fuel delivery device 120 to cause the fuel line 122 to supply the fuel 114 to the fuel tank 112 at the increased rate of fuel flow to reduce a time for supplying the fuel 114 to the fuel tank 112.

In some examples, the refueling system 300A, 300B, 400, 800 also increases the level of ionization of the air medium 132 in the fuel tank 112 to increase the rate at which the electrostatic charge accumulated on the surface 130 of the fuel 114 dissipates. For example, before and/or while supplying the fuel 114 from the fuel source 116 to the fuel tank 112, the control device 136 can cause the blower 354 of the ambient air 358 and/or the ionization radiation source 462 to increase the level of ionization of the air medium 132 in the fuel tank 112. Responsive to increasing the level of ionization of the air medium 132, the ion sensor 134 can determine the level of ionization of the air medium 132, the control device 136 can receive the sensor signal indicating the determined level of ionization, the control device 136 can determine the increased rate of fuel flow based on the determined level of ionization, and the control device 136 can cause the fuel line 122 to supply the fuel 114 to the fuel tank 112 at the increased rate of fuel flow.

In one implementation, the refueling system 300A, 300B, 400, 800 can increase the level of ionization of the air medium 132 and responsively perform the acts described above to increase the rate of fuel flow once during the refueling operation. In another implementation, the refueling system 300A, 300B, 400, 800 can iteratively repeat (i) increasing the level of ionization using the blower 354 of ambient air 358 and/or the ionization radiation source 462, (ii) determining the level of ionization (e.g., by measuring the level of ionization using the ion sensor 134 and/or by calculating the level of ionization using the control device 136), (iii) determining the increased rate of fuel flow by the control device 136, and (iv) supplying the fuel 114, via the fuel line 122, at the increased rate of fuel flow one or more times during the refueling operation to iteratively increase the increased rate of fuel flow and further reduce the time for supplying the fuel 114 to the fuel tank 112.

In the example refueling operation described above, the refueling system 100, 300A, 300B, 400, 800 first supplies the fuel at an initial rate of fuel flow and then increases the rate of fuel flow based on the determined level of ionization of the air medium. In an additional or alternative example, the refueling system 100, 300A, 300B, 400, 800 determines a rate of fuel flow based on the determined level of ionization before, during, or after initially supplying the fuel 114 to the fuel tank 112.

In this example, the refueling operation can include the ion sensor 134 determining the level of ionization of an air medium 132 in a fuel tank 112 and transmitting the sensor signal indicating the determined level of ionization to the control device 136. The control device 136 then determines, based on the determined level of ionization, a rate of fuel flow at which to supply the fuel 114 to the fuel tank 112. For example, the control device 136 can determine, based on the determined level of ionization, the rate of fuel flow that is configured to maintain the accumulated electrostatic charge below the threshold value, which is related to the potential for electrical discharge between the surface 130 of the fuel 114 and a structure of the fuel tank 112 due to the accumulated electrostatic charge. For instance, the control device 136 can use the lookup table and/or the algorithm stored in memory to determine the rate of fuel flow. Responsive to determining the rate of fuel flow, the control device 136 causes the fuel source 116 to supply, via the fuel line 122, the fuel 114 to the fuel tank 112 of the vehicle 110 at the determined rate of fuel flow.

In another example, a refueling operation can include exposing air in the air tank 878 to ionizing radiation to form ionized air 880. For example, the ionization radiation source 462 can expose the air in the air tank 878 to a radioactive gas to form the ionized air 880. In another example, the ionization radiation source 462 can expose the air in the air tank 878 to at least one of x-ray radiation, gamma ray radiation, alpha particles, or beta particles to form the ionized air 880.

The air tank 878 can then supply the ionized air 880 into the fuel tank 112 to increase a level of ionization of an air medium 132 in the fuel tank 112. Responsive to the air tank 878 supplying the ionized air 880 into the fuel tank 112, the ion sensor 134 determines the level of ionization of the air medium 132 in the fuel tank 112 and/or the control device 136 performs calculations to determine the level of ionization of the air medium 132. The control device 136 then determines, based on the determined level of ionization, a rate of fuel flow at which to supply the fuel 114 to the fuel tank 112. For example, the control device 136 can determine, based on the determined level of ionization, the rate of fuel flow that is configured to maintain the accumulated electrostatic charge below the threshold value, which is related to the potential for electrical discharge between the surface of the fuel and a structure of the fuel tank 112 due to the accumulated electrostatic charge. For instance, the control device 136 can use the lookup table and/or the algorithm stored in memory to determine the rate of fuel flow.

After determining the rate of fuel flow based on the determined level of ionization, the control device 136 transmits a control signal to the fuel source 116 to cause the fuel line 122 to supply the fuel 114 to the fuel tank 112 at the determined rate of fuel flow.

Figure 9:
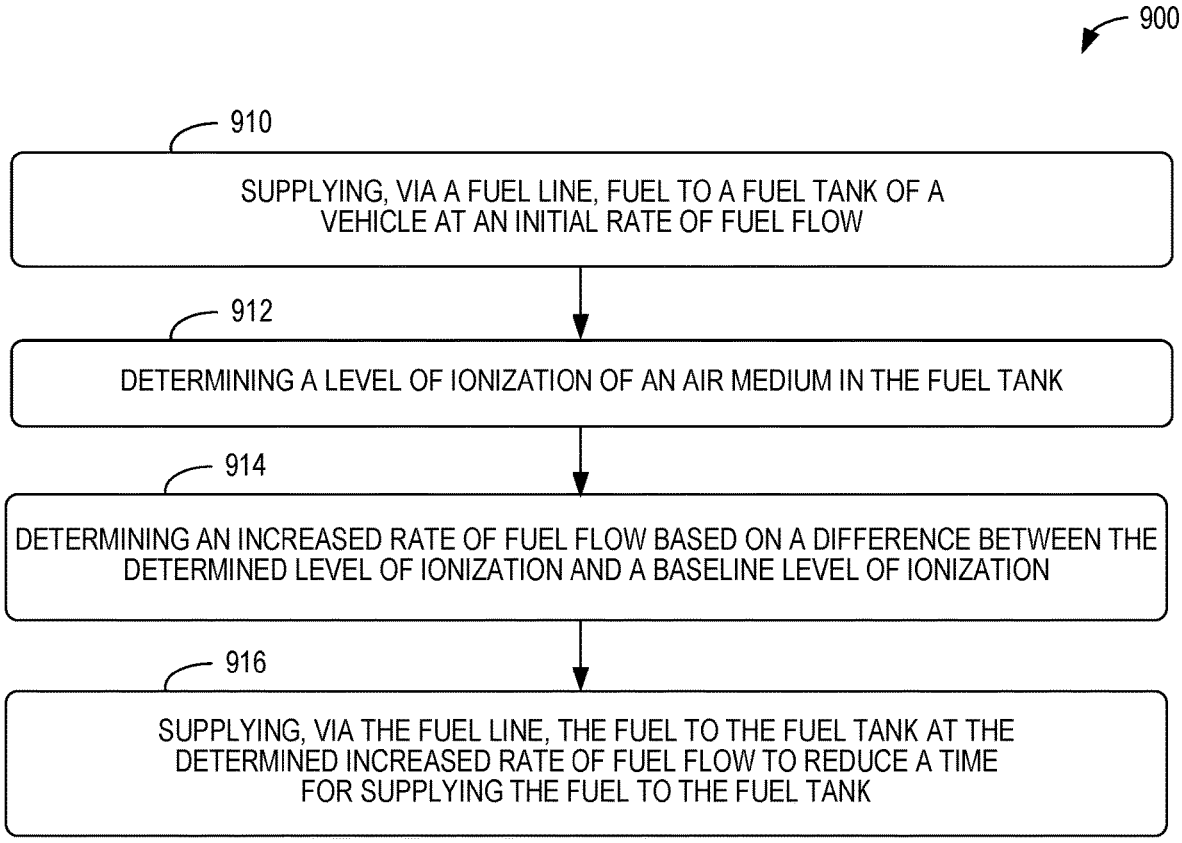
FIG. 9 illustrates a flow chart of an example process for supplying fuel to a fuel tank of a vehicle according to an example embodiment.

Referring now to FIG. 9, a flowchart for a process 900 of supplying fuel to a fuel tank of a vehicle is illustrated according to an example embodiment. As shown in FIG. 9, at block 910, the process 900 includes supplying, via a fuel line, fuel to a fuel tank of a vehicle at an initial rate of fuel flow. The act of supplying the fuel causes an electrostatic charge to accumulate on a surface of the fuel in the fuel tank. At block 912, the process 900 includes determining a level of ionization of an air medium in the fuel tank.

At block 914, the process 900 includes determining an increased rate of fuel flow based on a difference between the determined level of ionization and a baseline level of ionization. The electrostatic charge accumulated on the surface of the fuel dissipates at an increased rate when the determined level of ionization of the air medium is higher than the baseline level of ionization. At block 916, the process 900 includes supplying, via the fuel line, the fuel to the fuel tank at the determined increased rate of fuel flow to reduce a time for supplying the fuel to the fuel tank.

Figure 10:
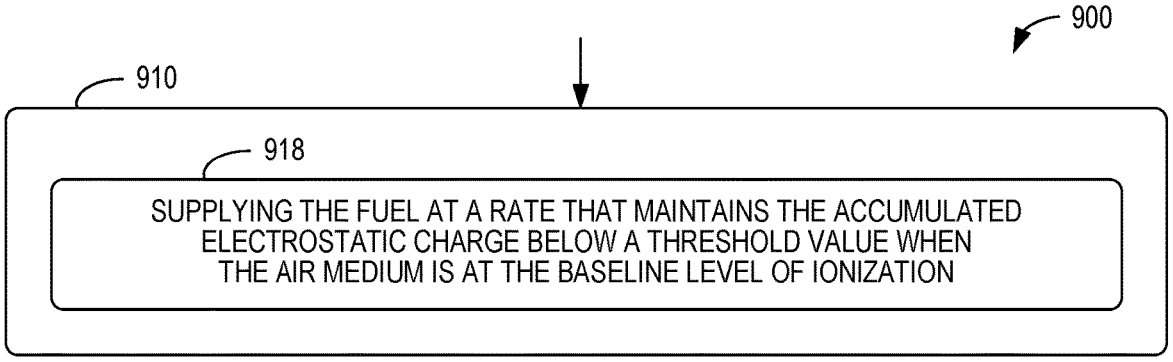
FIG. 10 illustrates a flow chart of an example process for supplying fuel to a fuel tank of a vehicle that can be used with the process shown in FIG. 9.

FIGS. 10-17 depict additional aspects of the process 900 according to further examples. As shown in FIG. 10, supplying the fuel at the initial rate at block 910 can include supplying the fuel at a rate that maintains the accumulated electrostatic charge below a threshold value when the air medium is at the baseline level of ionization at block 918. The threshold value can be related to a potential for electrical discharge between the surface of the fuel and a structure of the fuel tank due to the accumulated electrostatic charge.

Figure 11:
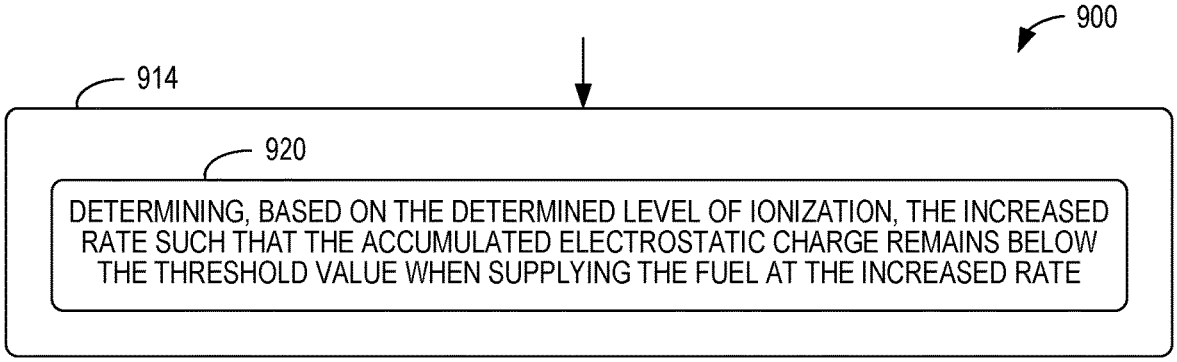
FIG. 11 illustrates a flow chart of an example process for supplying fuel to a fuel tank of a vehicle that can be used with the process shown in FIG. 10.

As shown in FIG. 11, determining the increased rate of fuel flow at block 914 can include determining, based on the determined level of ionization, the increased rate such that the accumulated electrostatic charge remains below the threshold value when supplying the fuel at the increased rate at block 920.

Figure 12:
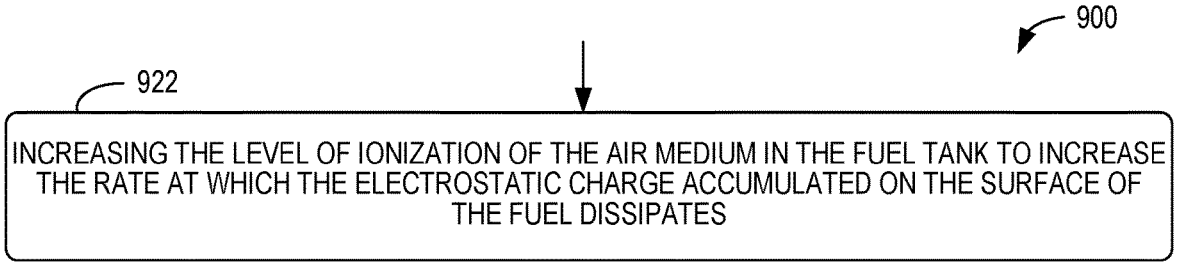
FIG. 12 illustrates a flow chart of an example process for supplying fuel to a fuel tank of a vehicle that can be used with the process shown in FIGS. 9-11.

As shown in FIG. 12, the process 900 can also include increasing the level of ionization of the air medium in the fuel tank to increase the rate at which the electrostatic charge accumulated on the surface of the fuel dissipates at block 922.

Figure 13:
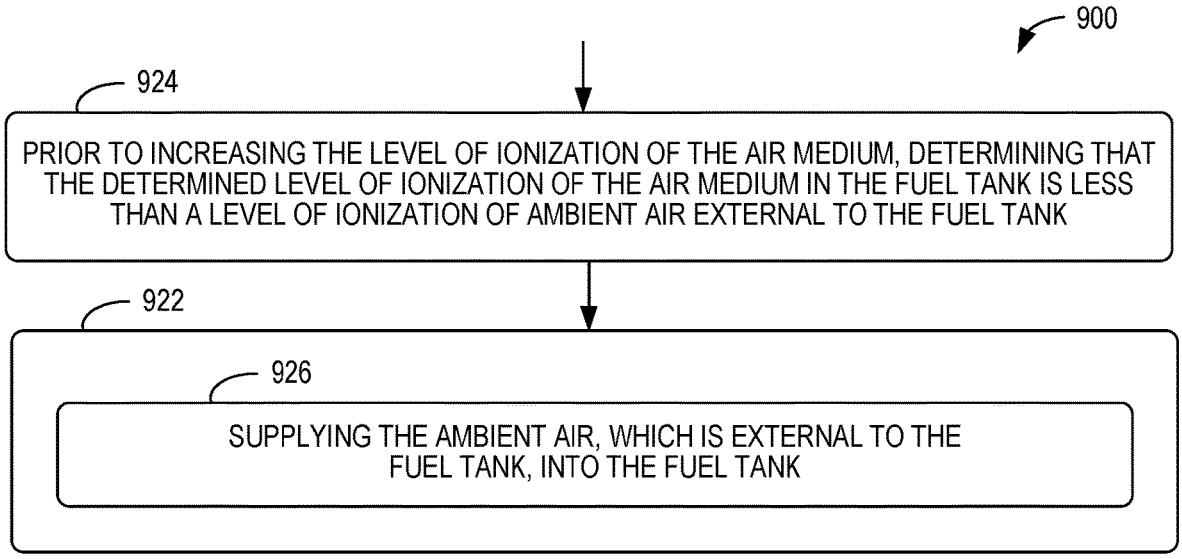
FIG. 13 illustrates a flow chart of an example process for supplying fuel to a fuel tank of a vehicle that can be used with the process shown in FIG. 12.

As shown in FIG. 13, prior to increasing the level of ionization of the air medium at block 922, the process 900 can include determining that the determined level of ionization of the air medium in the fuel tank is less than a level of ionization of ambient air external to the fuel tank at block 924. Also, as shown in FIG. 13, to increase the level of ionization of the air medium in the fuel tank at block 920, the process 900 can include supplying the ambient air, which is external to the fuel tank, into the fuel tank at block 926.

Figure 14:
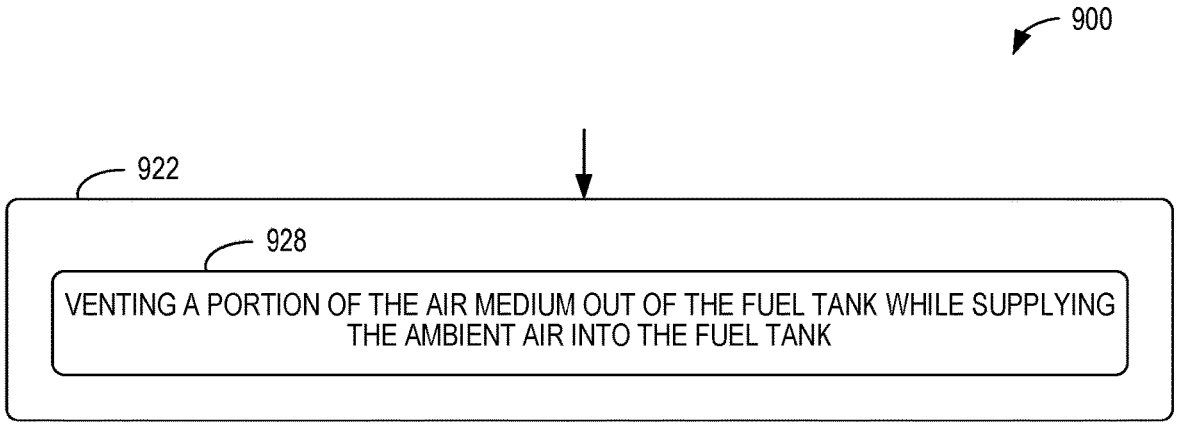
FIG. 14 illustrates a flow chart of an example process for supplying fuel to a fuel tank of a vehicle that can be used with the process shown in FIG. 13.

As shown in FIG. 14, increasing the level of ionization of the air medium in the fuel tank at block 920 can also include venting a portion of the air medium out of the fuel tank while supplying the ambient air into the fuel tank at block 928.

Figure 15:
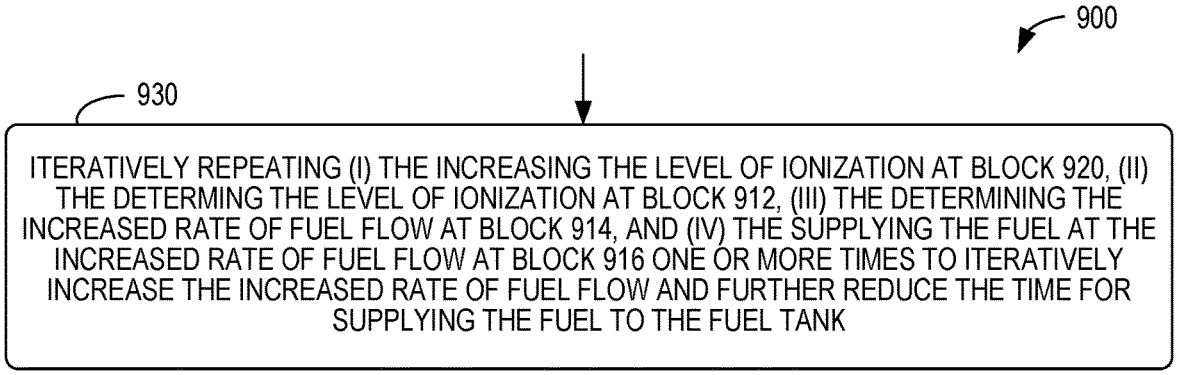
FIG. 15 illustrates a flow chart of an example process for supplying fuel to a fuel tank of a vehicle that can be used with the process shown in FIGS. 11-12.

As shown in FIG. 15, the process 900 can further include, at block 930, iteratively repeating (i) the increasing the level of ionization at block 920, (ii) the determining the level of ionization at block 912, (iii) the determining the increased rate of fuel flow at block 914, and (iv) the supplying the fuel at the increased rate of fuel flow at block 916 one or more times to iteratively increase the increased rate of fuel flow and further reduce the time for supplying the fuel to the fuel tank.

Figure 16:
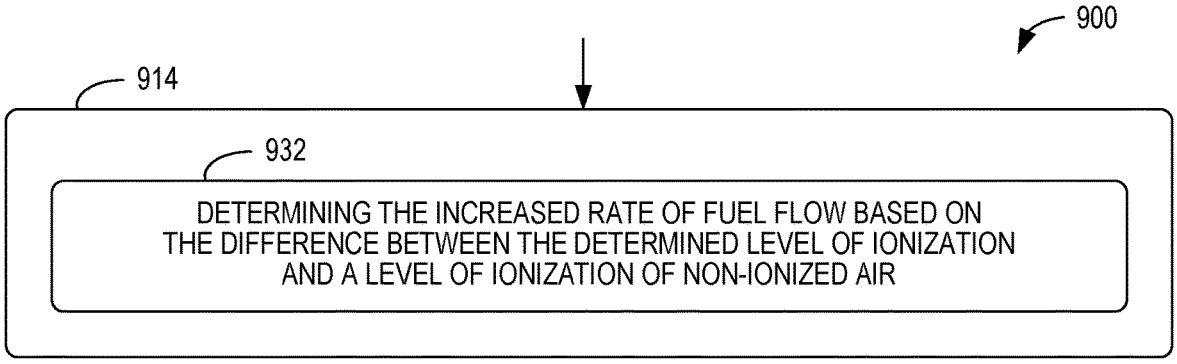
FIG. 16 illustrates a flow chart of an example process for supplying fuel to a fuel tank of a vehicle that can be used with the process shown in FIGS. 9-15.
Figure 17:
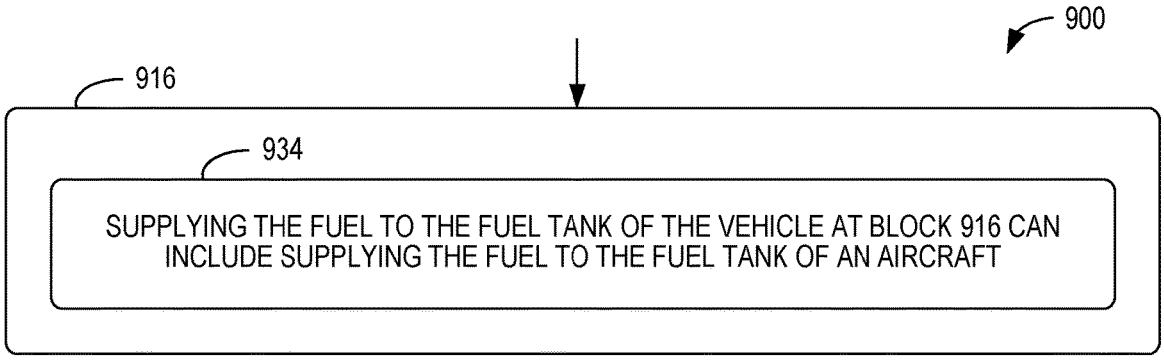
FIG. 17 illustrates a flow chart of an example process for supplying fuel to a fuel tank of a vehicle that can be used with the process shown in FIGS. 9-16.

As shown in FIG. 16, determining the increased rate of fuel flow based on the difference between the determined level of ionization and the baseline level of ionization at block 914 can include determining the increased rate of fuel flow based on the difference between the determined level of ionization and a level of ionization of non-ionized air at block 932. As shown in FIG. 17, supplying the fuel to the fuel tank of the vehicle at block 916 can include supplying the fuel to the fuel tank of an aircraft at block 934.

Figure 18:
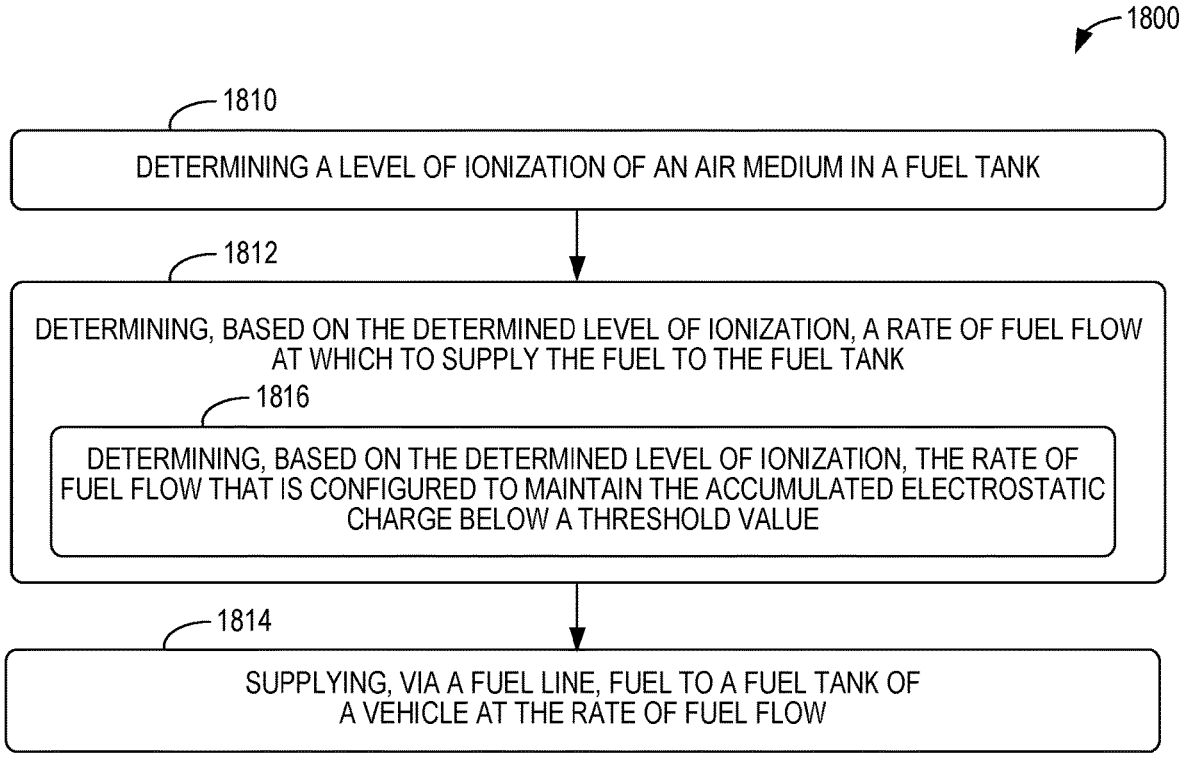
FIG. 18 illustrates a flow chart of an example process for supplying fuel to a fuel tank of a vehicle according to an example embodiment.

Referring now to FIG. 18, a flowchart for a process 1800 of supplying fuel to a fuel tank of a vehicle is illustrated according to an example embodiment. As shown in FIG. 18, at block 1810, the process 1800 includes determining a level of ionization of an air medium in a fuel tank. At block 1812, the process 1800 includes determining, based on the determined level of ionization, a rate of fuel flow at which to supply the fuel to the fuel tank. At block 1814, the process 1800 includes supplying, via a fuel line, fuel to a fuel tank of a vehicle at the rate of fuel flow.

In the process 1800, supplying the fuel at block 1814 causes an electrostatic charge to accumulate on a surface of the fuel in the fuel tank. As shown in FIG. 18, determining the rate of fuel flow at block 1812 includes determining, based on the determined level of ionization, the rate of fuel flow that is configured to maintain the accumulated electrostatic charge below a threshold value at block 1816. The threshold value is related to a potential for electrical discharge between the surface of the fuel and a structure of the fuel tank due to the accumulated electrostatic charge.

Figure 19:
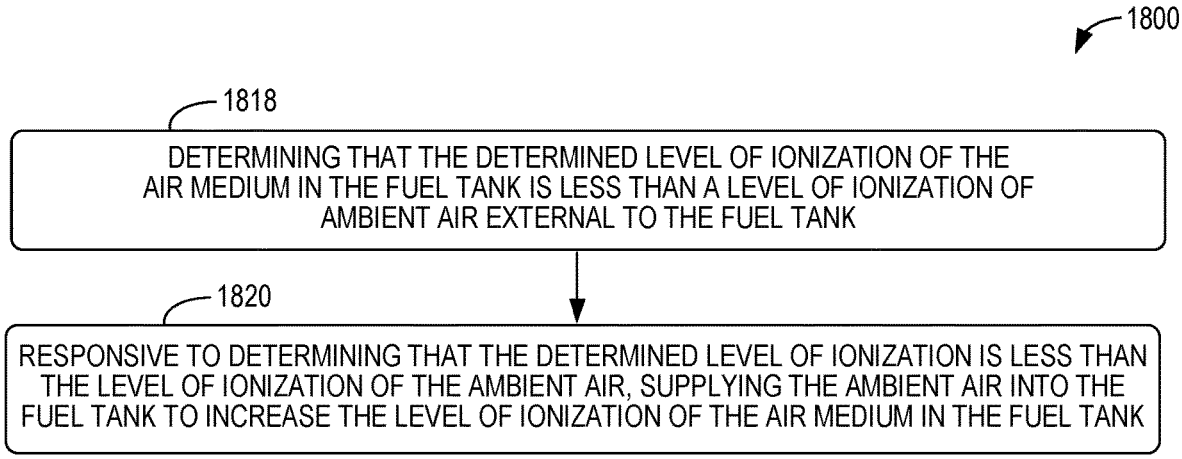
FIG. 19 illustrates a flow chart of an example process for supplying fuel to a fuel tank of a vehicle that can be used with the process shown in FIG. 18.
Figure 20:
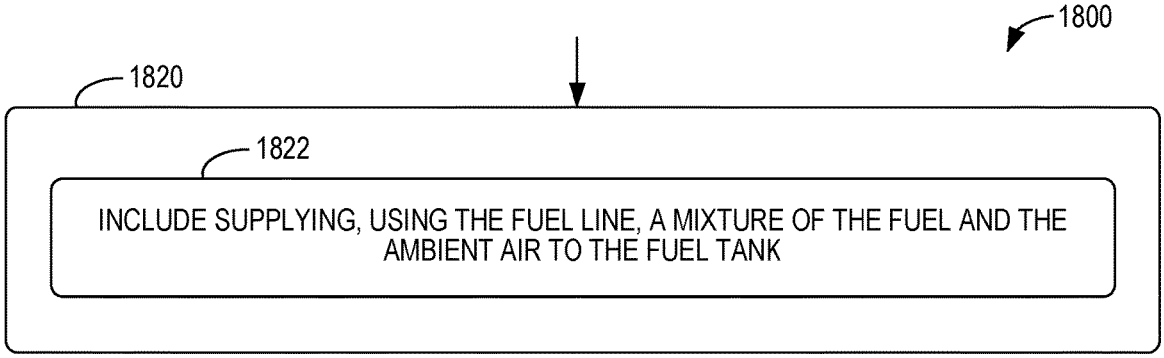
FIG. 20 illustrates a flow chart of an example process for supplying fuel to a fuel tank of a vehicle that can be used with the process shown in FIG. 19.

FIGS. 19-20 depict additional aspects of the process 1800 according to further examples. As shown in FIG. 19, the process 1800 can also include determining that the determined level of ionization of the air medium in the fuel tank is less than a level of ionization of ambient air external to the fuel tank at block 1818. Responsive to determining that the determined level of ionization is less than the level of ionization of the ambient air at block 1818, the process 1800 can include supplying the ambient air into the fuel tank to increase the level of ionization of the air medium in the fuel tank at block 1820. As shown in FIG. 20, supplying the ambient air into the fuel tank at block 1820 can include supplying, using the fuel line, a mixture of the fuel and the ambient air to the fuel tank at block 1822.

Figure 21:
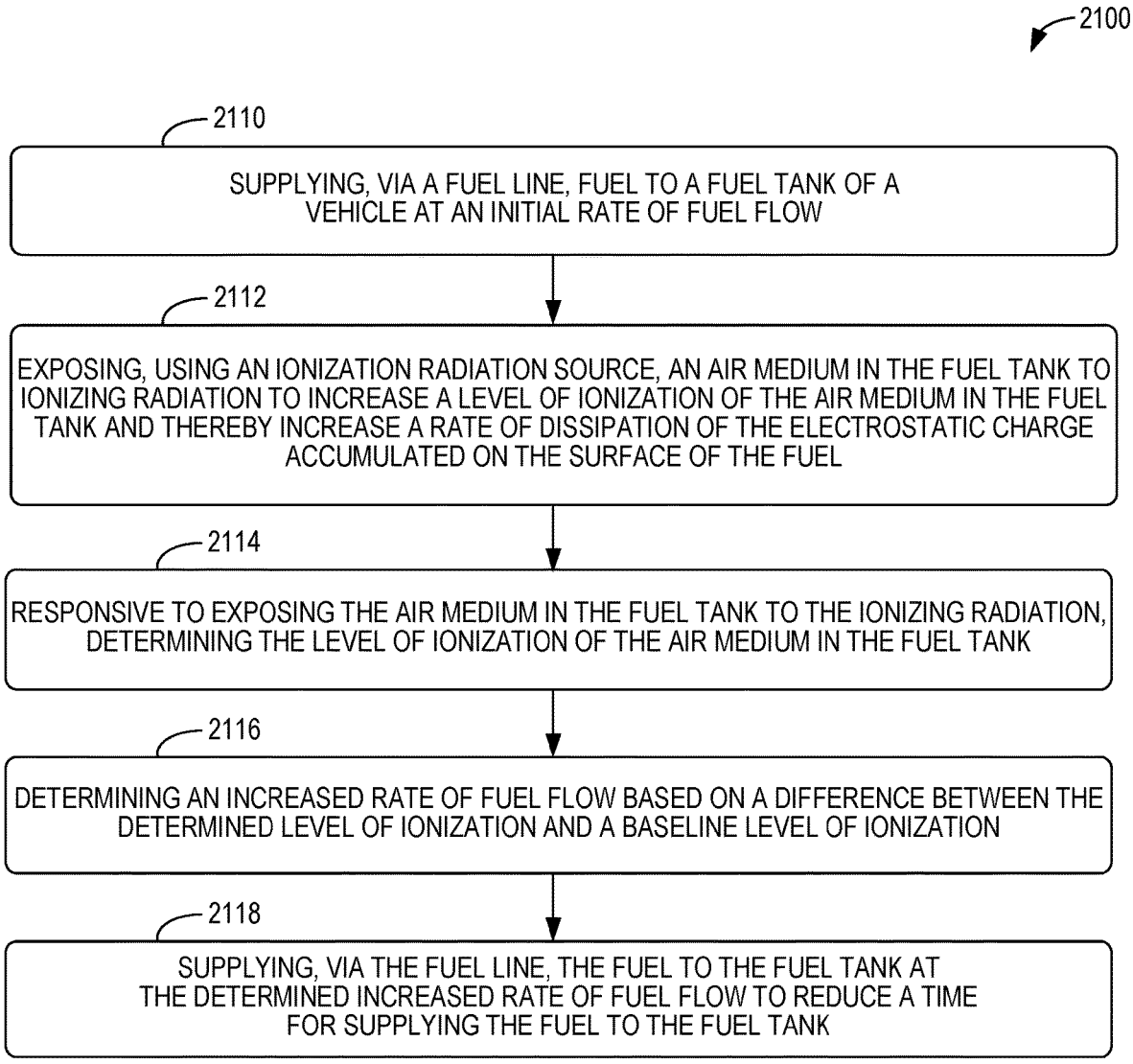
FIG. 21 illustrates a flow chart of an example process for supplying fuel to a fuel tank of a vehicle according to an example embodiment.

Referring now to FIG. 21, a flowchart for a process 2100 of supplying fuel to a fuel tank of a vehicle is illustrated according to an example embodiment. As shown in FIG. 21, at block 2110, the process 2100 includes supplying, via a fuel line, fuel to a fuel tank of a vehicle at an initial rate of fuel flow. The act of supplying the fuel causes an electrostatic charge to accumulate on a surface of the fuel in the fuel tank. At block 2112, the process 2100 includes exposing, using an ionization radiation source, an air medium in the fuel tank to ionizing radiation to increase a level of ionization of the air medium in the fuel tank and thereby increase a rate of dissipation of the electrostatic charge accumulated on the surface of the fuel.

Responsive to exposing the air medium in the fuel tank to the ionizing radiation at block 2112, the process 2100 includes determining the level of ionization of the air medium in the fuel tank at block 2114. At block 2116, the process 2100 includes determining an increased rate of fuel flow based on a difference between the determined level of ionization and a baseline level of ionization. The electrostatic charge accumulated on the surface of the fuel dissipates at an increased rate when the determined level of ionization of the air medium is higher than the baseline level of ionization. At block 2118, the process 2100 includes supplying, via the fuel line, the fuel to the fuel tank at the determined increased rate of fuel flow to reduce a time for supplying the fuel to the fuel tank.

Figure 22:
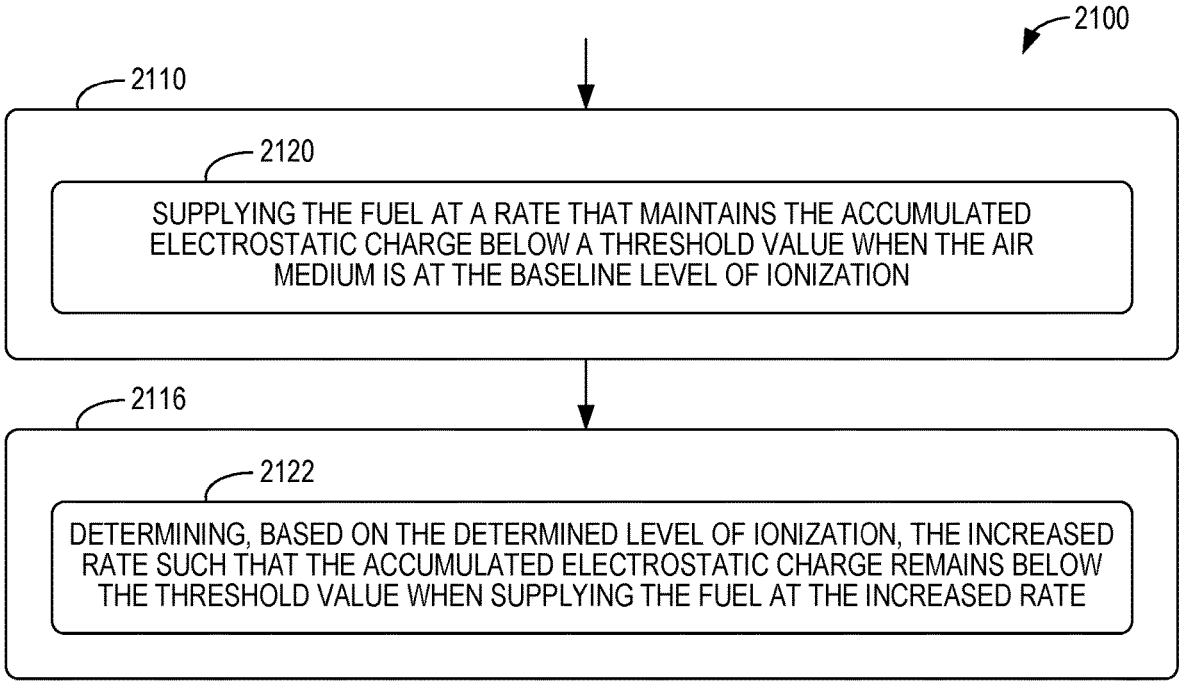
FIG. 22 illustrates a flow chart of an example process for supplying fuel to a fuel tank of a vehicle that can be used with the process shown in FIG. 21.

FIGS. 22-30 depict additional aspects of the process 2100 according to further examples. As shown in FIG. 22, supplying the fuel at the initial rate at block 2110 can include supplying the fuel at a rate that maintains the accumulated electrostatic charge below a threshold value when the air medium is at the baseline level of ionization at block 2120. The threshold value is related to a potential for electrical discharge between the surface of the fuel and a structure of the fuel tank due to the accumulated electrostatic charge. Also, as shown in FIG. 22, determining the increased rate of fuel flow at block 2116 can include determining, based on the determined level of ionization, the increased rate such that the accumulated electrostatic charge remains below the threshold value when supplying the fuel at the increased rate at block 2122.

Figure 23:
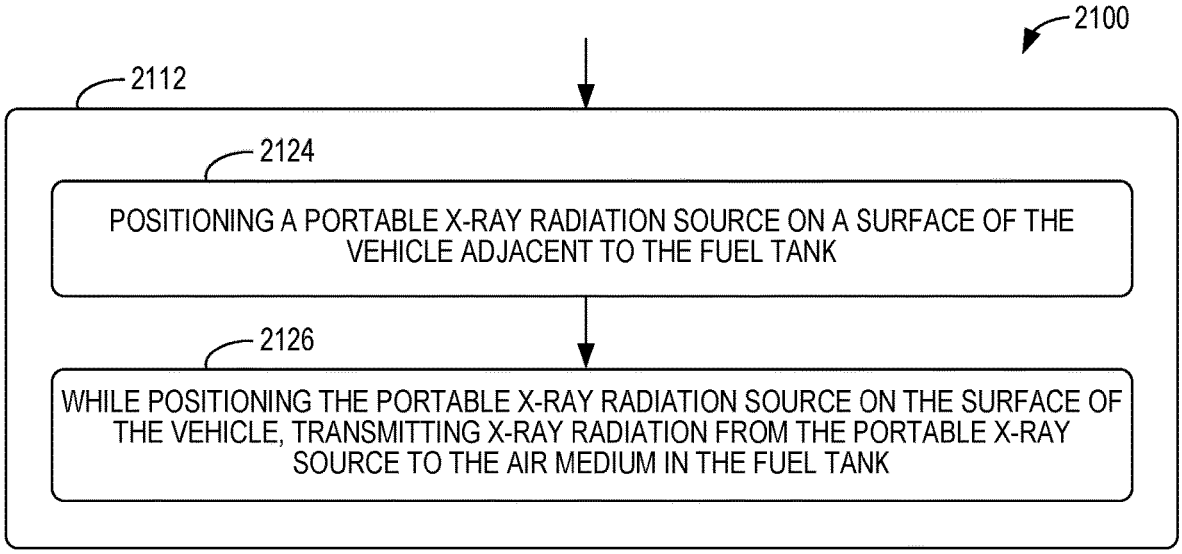
FIG. 23 illustrates a flow chart of an example process for supplying fuel to a fuel tank of a vehicle that can be used with the process shown in FIGS. 21-22.

As shown in FIG. 23, exposing the air medium in the fuel tank to the ionizing radiation at block 2112 can include (i) positioning a portable x-ray radiation source on a surface of the vehicle adjacent to the fuel tank at block 2124, and (ii) while positioning the portable x-ray radiation source on the surface of the vehicle at block 2124, transmitting x-ray radiation from the portable x-ray source to the air medium in the fuel tank at block 2126.

Figure 24:
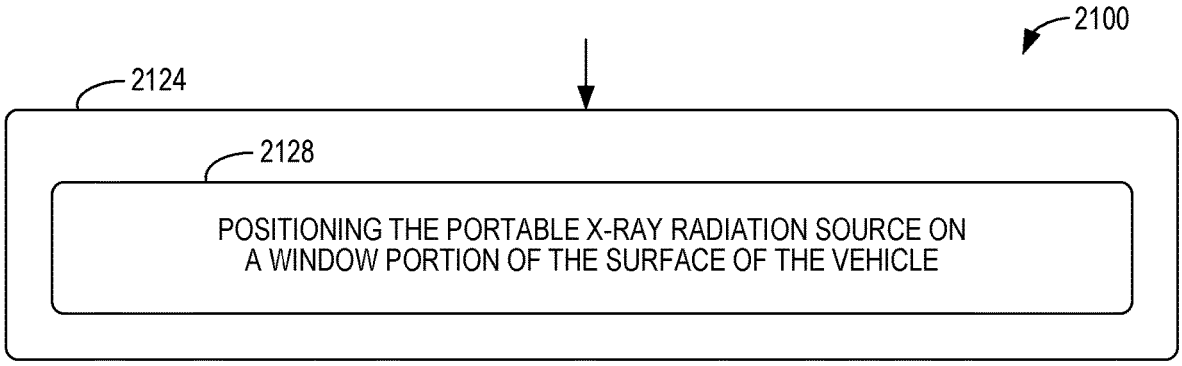
FIG. 24 illustrates a flow chart of an example process for supplying fuel to a fuel tank of a vehicle that can be used with the process shown in FIG. 23.
Figure 25:
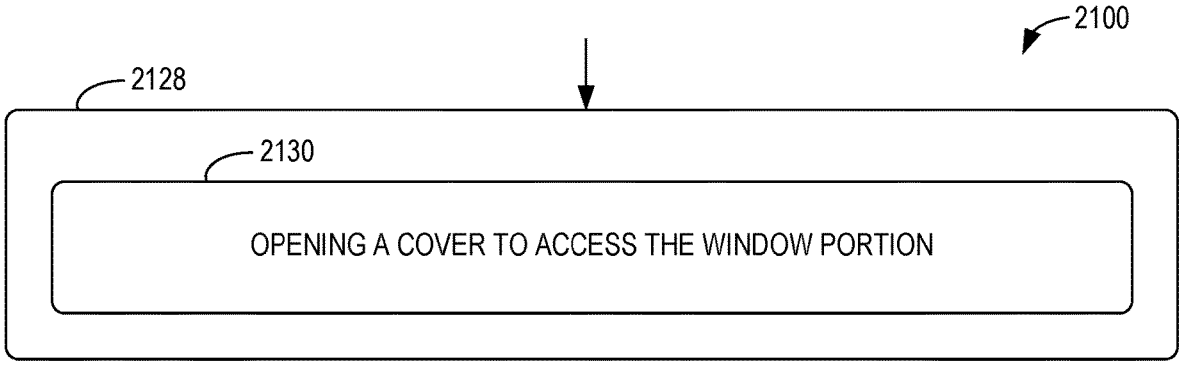
FIG. 25 illustrates a flow chart of an example process for supplying fuel to a fuel tank of a vehicle that can be used with the process shown in FIG. 24.

As shown in FIG. 24, positioning the portable x-ray radiation source at block 2124 can include positioning the portable x-ray radiation source on a window portion of the surface of the vehicle at block 2128. The window portion has a higher x-ray radiation transmissivity than a portion of the surface of the vehicle adjacent to the window portion. As shown in FIG. 25, positioning the portable x-ray radiation source at block 2128 can include opening a cover to access the window portion at block 2130. A combination of the cover and the window portion provides a lower x-ray radiation transmissivity into the fuel tank when the cover is closed than the x-ray transmissivity of the window portion alone when the cover is open.

Figure 26:
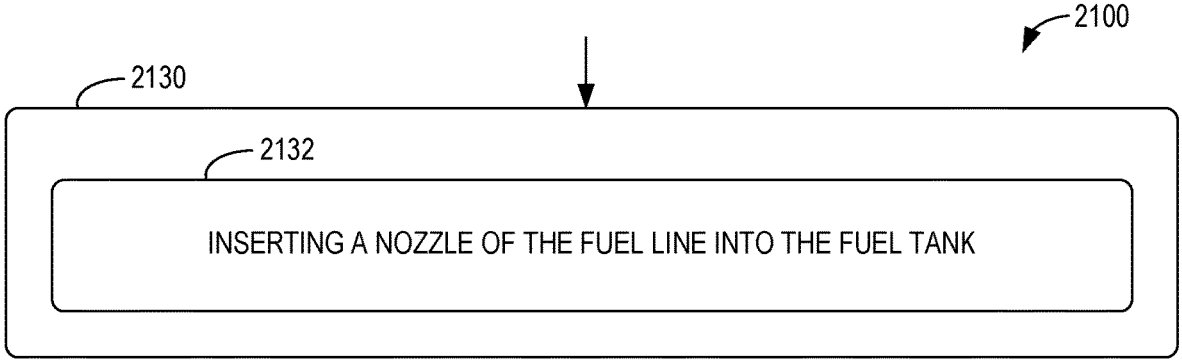
FIG. 26 illustrates a flow chart of an example process for supplying fuel to a fuel tank of a vehicle that can be used with the process shown in FIGS. 21-25.

As shown in FIG. 26, exposing the fuel tank to the ionizing radiation at block 2112 can include inserting a nozzle of the fuel line into the fuel tank at block 2132. In the process 2100 of FIG. 26, the nozzle includes the ionization radiation source.

Figure 27:
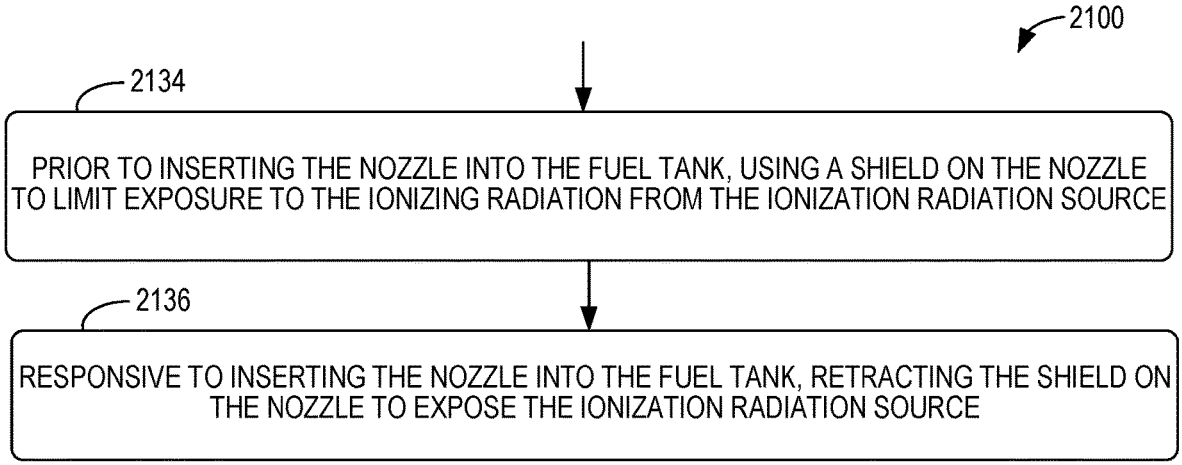
FIG. 27 illustrates a flow chart of an example process for supplying fuel to a fuel tank of a vehicle that can be used with the process shown in FIG. 26.
Figure 28:
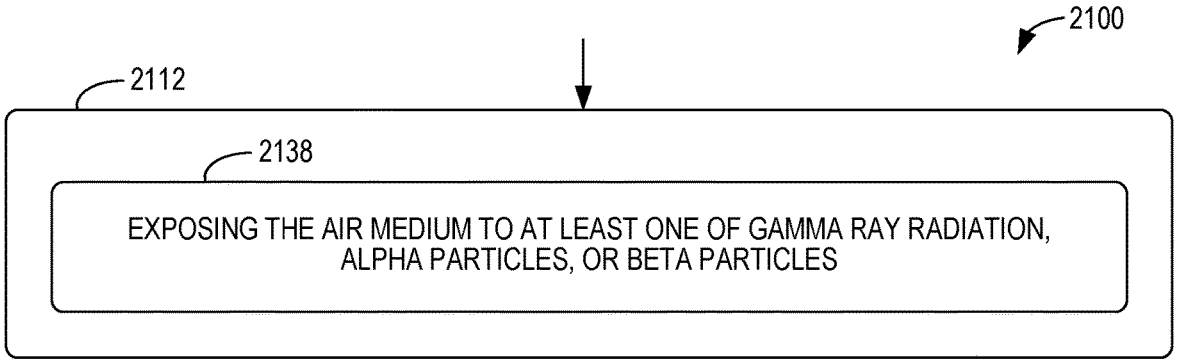
FIG. 28 illustrates a flow chart of an example process for supplying fuel to a fuel tank of a vehicle that can be used with the process shown in FIGS. 21-27.

As shown in FIG. 27, prior to inserting the nozzle into the fuel tank at block 2132, the process 2100 can include using a shield on the nozzle to limit exposure to the ionizing radiation from the ionization radiation source at block 2134. Responsive to inserting the nozzle into the fuel tank at block 2132, the process 2100 can include retracting the shield on the nozzle to expose the ionization radiation source at block 2136. As shown in FIG. 28, exposing the air medium to the ionizing radiation at block 2112 can include exposing the air medium to at least one of gamma ray radiation, alpha particles, or beta particles at block 2138.

Figure 29:
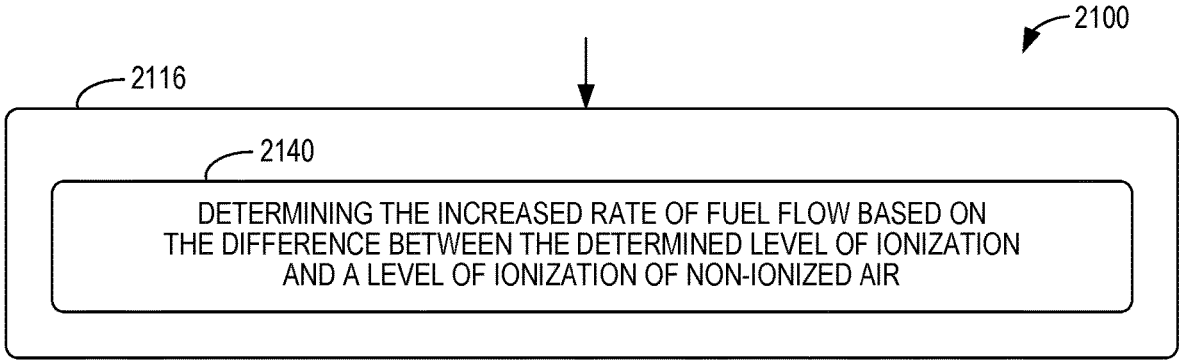
FIG. 29 illustrates a flow chart of an example process for supplying fuel to a fuel tank of a vehicle that can be used with the process shown in FIGS. 21-28.
Figure 30:
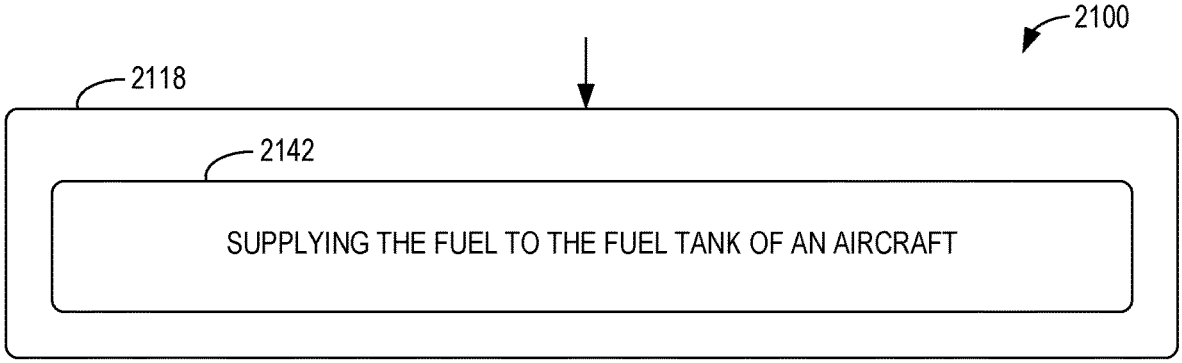
FIG. 30 illustrates a flow chart of an example process for supplying fuel to a fuel tank of a vehicle that can be used with the process shown in FIGS. 21-29.

As shown in FIG. 29, determining the increased rate of fuel flow based on the difference between the determined level of ionization and the baseline level of ionization at block 2116 can include determining the increased rate of fuel flow based on the difference between the determined level of ionization and a level of ionization of non-ionized air at block 2140. As shown in FIG. 30, supplying the fuel to the fuel tank of the vehicle at block 2118 can include supplying the fuel to the fuel tank of an aircraft at block 2142.

Figure 31:
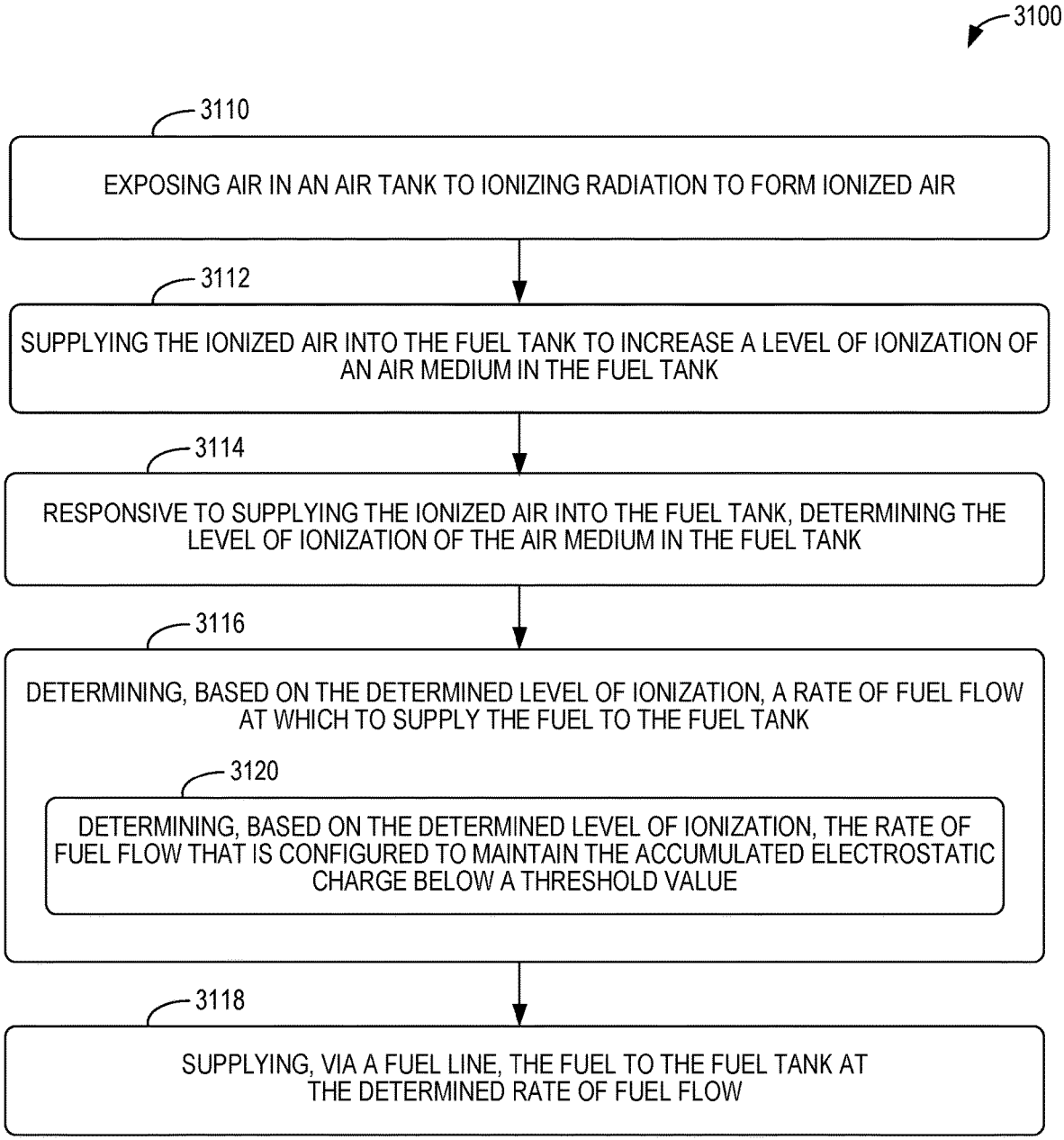
FIG. 31 illustrates a flow chart of an example process for supplying fuel to a fuel tank of a vehicle according to an example embodiment.

Referring now to FIG. 31, a flowchart for a process 3100 of supplying fuel to a fuel tank of a vehicle is illustrated according to an example embodiment. As shown in FIG. 31, at block 3110, the process 3100 includes exposing air in an air tank to ionizing radiation to form ionized air. The air tank is external to the fuel tank of the vehicle. At block 3112, the process 3100 includes supplying the ionized air into the fuel tank to increase a level of ionization of an air medium in the fuel tank.

Responsive to supplying the ionized air into the fuel tank at block 3112, the process 3100 includes determining the level of ionization of the air medium in the fuel tank at block 3114. At block 3116, the process 3100 includes determining, based on the determined level of ionization, a rate of fuel flow at which to supply the fuel to the fuel tank. At block 3118, the process 3100 includes supplying, via a fuel line, the fuel to the fuel tank at the determined rate of fuel flow.

Supplying the fuel at block 3118 causes an electrostatic charge to accumulate on a surface of the fuel in the fuel tank. As shown in FIG. 31, determining the rate of fuel flow at 3116 includes determining, based on the determined level of ionization, the rate of fuel flow that is configured to maintain the accumulated electrostatic charge below a threshold value at block 3120. The threshold value is related to a potential for electrical discharge between the surface of the fuel and a structure of the fuel tank due to the accumulated electrostatic charge.

Figure 32:
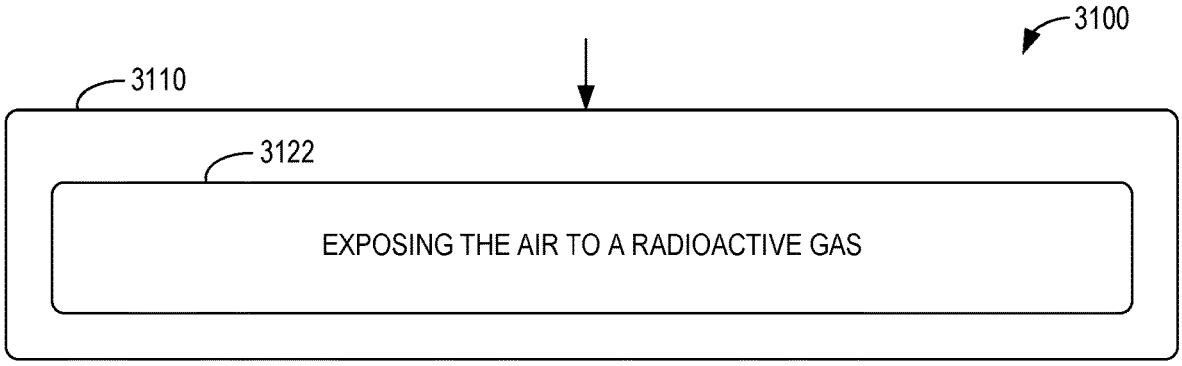
FIG. 32 illustrates a flow chart of an example process for supplying fuel to a fuel tank of a vehicle that can be used with the process shown in FIG. 31.
Figure 33:
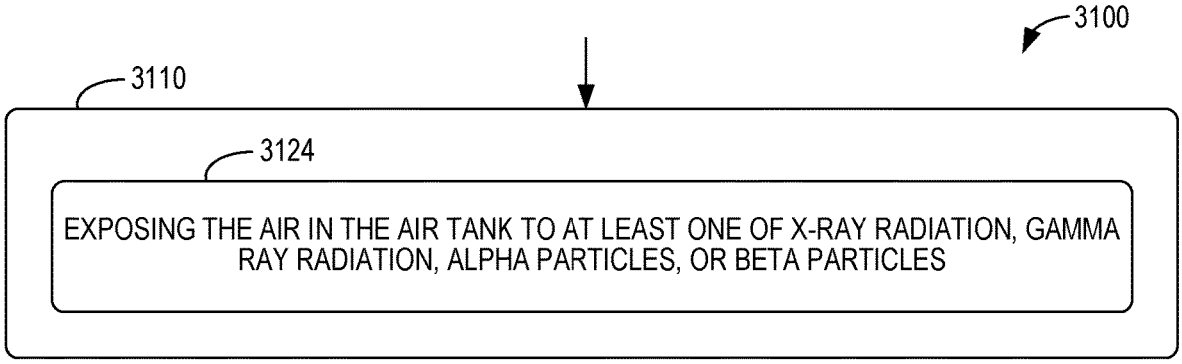
FIG. 33 illustrates a flow chart of an example process for supplying fuel to a fuel tank of a vehicle that can be used with the process shown in FIGS. 31-32.

FIGS. 32-33 depict additional aspects of the process 3100 according to further examples. As shown in FIG. 32, exposing the air in the air tank to ionizing radiation at block 3110 can include exposing the air to a radioactive gas at block 3122. As shown in FIG. 33, exposing the air in the air tank to ionizing radiation at block 3110 can include exposing the air in the air tank to at least one of x-ray radiation, gamma ray radiation, alpha particles, or beta particles at block 3124.

Any of the blocks shown in FIGS. 9-33 may represent a module, a segment, or a portion of program code, which includes one or more instructions executable by a processor for implementing specific logical functions or steps in the process. The program code may be stored on any type of computer readable medium or data storage, for example, such as a storage device including a disk or hard drive. Further, the program code can be encoded on a computer-readable storage media in a machine-readable format, or on other non-transitory media or articles of manufacture. The computer readable medium may include non-transitory computer readable medium or memory, for example, such as computer-readable media that stores data for short periods of time like register memory, processor cache and Random Access Memory (RAM). The computer readable medium may also include non-transitory media, such as secondary or persistent long term storage, like read only memory (ROM), optical or magnetic disks, compact-disc read only memory (CD-ROM), for example. The computer readable media may also be any other volatile or non-volatile storage systems. The computer readable medium may be considered a tangible computer readable storage medium, for example.

In some instances, components of the devices and/or systems described herein may be configured to perform the functions such that the components are actually configured and structured (with hardware and/or software) to enable such performance. Example configurations then include one or more processors executing instructions to cause the system to perform the functions. Similarly, components of the devices and/or systems may be configured so as to be arranged or adapted to, capable of, or suited for performing the functions, such as when operated in a specific manner.

The description of the different advantageous arrangements has been presented for purposes of illustration and description, and is not intended to be exhaustive or limited to the embodiments in the form disclosed. Many modifications and variations will be apparent to those of ordinary skill in the art. Further, different advantageous embodiments may describe different advantages as compared to other advantageous embodiments. The embodiment or embodiments selected are chosen and described in order to explain the principles of the embodiments, the practical application, and to enable others of ordinary skill in the art to understand the disclosure for various embodiments with various modifications as are suited to the particular use contemplated.

What is claimed is:

1. A method of supplying fuel to a fuel tank of a vehicle, comprising:

supplying, via a fuel line, fuel to a fuel tank of a vehicle at an initial rate of fuel flow, wherein supplying the fuel causes an electrostatic charge to accumulate on a surface of the fuel in the fuel tank;

determining a level of ionization of an air medium in the fuel tank;

determining an increased rate of fuel flow based on a difference between the determined level of ionization and a baseline level of ionization, wherein the electrostatic charge accumulated on the surface of the fuel dissipates at an increased rate when the determined level of ionization of the air medium is higher than the baseline level of ionization;

supplying, via the fuel line, the fuel to the fuel tank at the determined increased rate of fuel flow to reduce a time for supplying the fuel to the fuel tank;

increasing the level of ionization of the air medium in the fuel tank to increase a rate at which the electrostatic charge accumulated on the surface of the fuel dissipates; and prior to increasing the level of ionization of the air medium, determining that the determined level of ionization of the air medium in the fuel tank is less than a level of ionization of ambient air external to the fuel tank, and wherein increasing the level of ionization of the air medium in the fuel tank comprises supplying the ambient air, which is external to the fuel tank, into the fuel tank.

2. The method of claim 1, wherein supplying the fuel at the initial rate comprises supplying the fuel at a rate that maintains the accumulated electrostatic charge below a threshold value when the air medium is at the baseline level of ionization, and wherein the threshold value is related to a potential for electrical discharge between the surface of the fuel and a structure of the fuel tank due to the accumulated electrostatic charge.

3. The method of claim 2, wherein determining the increased rate of fuel flow comprises determining, based on the determined level of ionization, the increased rate such that the accumulated electrostatic charge remains below the threshold value when supplying the fuel at the increased rate.

4. The method of claim 1, wherein increasing the level of ionization of the air medium in the fuel tank further comprises venting a portion of the air medium out of the fuel tank while supplying the ambient air into the fuel tank.

5. The method of claim 1, further comprising iteratively repeating (i) the increasing the level of ionization, (ii) the determining the level of ionization, (iii) the determining the increased rate of fuel flow, and (iv) the supplying the fuel at the increased rate of fuel flow one or more times to iteratively increase the increased rate of fuel flow and further reduce the time for supplying the fuel to the fuel tank.

6. The method of claim 1, wherein determining the increased rate of fuel flow based on the difference between the determined level of ionization and the baseline level of ionization comprises determining the increased rate of fuel flow based on the difference between the determined level of ionization and a level of ionization of non-ionized air.

7. The method of claim 1, wherein supplying the fuel to the fuel tank of the vehicle comprises supplying the fuel to the fuel tank of an aircraft.

8. The method of claim 1, wherein the determined level of ionization is related to an extent of ionizing radiation in an environment proximate to the fuel tank.

9. A system for supplying fuel to a fuel tank of a vehicle, comprising:

a fuel line configured to supply fuel to a fuel tank of a vehicle, wherein a flow of the fuel in the fuel line causes an accumulation of an electrostatic charge on a surface of the fuel in the fuel tank;

a sensor configured to determine a level of ionization of an air medium in the fuel tank and generate a sensor signal indicating the determined level of ionization;

a blower configured to supply, from an environment external to the fuel tank, ambient air into the fuel tank; and a control device in communication with the sensor and configured to:

cause the fuel line to supply the fuel to the fuel tank at an initial rate of fuel flow, receive the sensor signal indicating the determined level of ionization, determine an increased rate of fuel flow based on a difference between the determined level of ionization and a baseline level of ionization, wherein the electrostatic charge accumulated on the surface of the fuel dissipates at an increased rate when the determined level of ionization of the air medium is higher than the baseline level of ionization, and cause the fuel line to supply the fuel to the fuel tank at the determined increased rate of fuel flow to reduce a time for supplying the fuel to the fuel tank, increase the level of ionization of the air medium in the fuel tank to increase the rate at which the electrostatic charge accumulated on the surface of the fuel dissipates, wherein, to increase the level of ionization of the air medium in the fuel tank, the control device is further configured to:

determine that the determined level of ionization of the air medium in the fuel tank is less than a level of ionization of the ambient air, and responsive to a determination that the determined level of ionization is less than the level of ionization of the ambient air, cause the blower to supply the ambient air into the fuel tank.

10. The system of claim 9, wherein the initial rate is configured to maintain the accumulated electrostatic charge below a threshold value when the air medium is at the baseline level of ionization, wherein the threshold value is related to a potential for electrical discharge between the surface of the fuel and a structure of the fuel tank due to the accumulated electrostatic charge, and wherein the control device is configure to determine, based on the determined level of ionization, the increased rate such that the accumulated electrostatic charge remains below the threshold value when the fuel line supplies the fuel at the increased rate.

11. The system of claim 10, further comprising:

a vent configured to vent a portion of the air medium out of the fuel tank while the blower supplies the ambient air into the fuel tank.

12. The system of claim 9, the control device is configured to iteratively (i) cause the blower to increase the level of ionization, (ii) receive the sensor signal indicating the determined level of ionization, (iii) determine the increased rate of fuel flow, and (iv) cause the fuel line to supply the fuel at the increased rate of fuel flow one or more times to iteratively increase the increased rate of fuel flow and further reduce the time for supplying the fuel to the fuel tank.

13. The system of claim 9, wherein the baseline level of ionization is a level of ionization of non-ionized air.

14. The system of claim 9, wherein the vehicle comprises an aircraft.

15. A method of supplying fuel to a fuel tank of a vehicle, comprising:

determining a level of ionization of an air medium in a fuel tank;

determining, based on the determined level of ionization, a rate of fuel flow at which to supply the fuel to the fuel tank;

supplying, via a fuel line, fuel to a fuel tank of a vehicle at the rate of fuel flow;

determining that the determined level of ionization of the air medium in the fuel tank is less than a level of ionization of ambient air external to the fuel tank; and responsive to determining that the determined level of ionization is less than the level of ionization of the ambient air, supplying the ambient air into the fuel tank to increase the level of ionization of the air medium in the fuel tank, wherein supplying the fuel causes an electrostatic charge to accumulate on a surface of the fuel in the fuel tank, wherein determining the rate of fuel flow comprises determining, based on the determined level of ionization, the rate of fuel flow that maintains the accumulated electrostatic charge below a threshold value, and wherein the threshold value is related to a potential for electrical discharge between the surface of the fuel and a structure of the fuel tank due to the accumulated electrostatic charge.

16. The method of claim 15, wherein supplying the ambient air into the fuel tank comprises supplying, using the fuel line, a mixture of the fuel and the ambient air to the fuel tank.

17. The method of claim 15, wherein supplying the fuel to the fuel tank of the vehicle comprises supplying the fuel to the fuel tank of an aircraft.

18. The method of claim 15, wherein the determined level of ionization is related to an extent of ionizing radiation in an environment proximate to the fuel tank.

19. The method of claim 15, wherein increasing the level of ionization of the air medium in the fuel tank further comprises venting a portion of the air medium out of the fuel tank while supplying the ambient air into the fuel tank.

20. The method of claim 15, wherein determining the rate of fuel flow comprises determining, based on the determined level of ionization, the rate of fuel flow such that the accumulated electrostatic charge remains below a threshold value while supplying the fuel at the rate of fuel flow.

* * * * *